US010181650B2

(12) United States Patent
Georgakopoulos et al.

(10) Patent No.: US 10,181,650 B2
(45) Date of Patent: Jan. 15, 2019

(54) ORIGAMI-FOLDED ANTENNAS AND METHODS FOR MAKING THE SAME

(71) Applicants: Stavros Georgakopoulos, Boca Raton, FL (US); Xueli Liu, Miami, FL (US)

(72) Inventors: Stavros Georgakopoulos, Boca Raton, FL (US); Xueli Liu, Miami, FL (US)

(73) Assignee: The Florida International University Board of Trustees, Miami, FL (US)

( * ) Notice: Subject to any disclaimer, the term of this patent is extended or adjusted under 35 U.S.C. 154(b) by 179 days.

(21) Appl. No.: 15/405,729

(22) Filed: Jan. 13, 2017

(65) Prior Publication Data

US 2018/0205153 A1 Jul. 19, 2018

(51) Int. Cl.
*H01Q 11/08* (2006.01)
*H01Q 25/00* (2006.01)

(52) U.S. Cl.
CPC ..... *H01Q 11/086* (2013.01); *H01Q 25/00* (2013.01)

(58) Field of Classification Search
CPC ..... H01Q 1/08; H01Q 1/36–1/362; H01Q 11/08–11/086
USPC ..... 343/880, 881, 895
See application file for complete search history.

(56) References Cited

U.S. PATENT DOCUMENTS 4,028,701 A * 6/1977 Parks ..... H01Q 15/20 342/8
7,079,079 B2 * 7/2006 Jo ..... H01Q 1/243 343/700 MS
9,214,722 B2 12/2015 Georgakopoulos et al.
2014/0232611 A1 * 8/2014 Ochoa ..... H01Q 1/288 343/881
2014/0340275 A1 * 11/2014 Georgakopoulos ..... H01Q 1/36 343/834

OTHER PUBLICATIONS

Wong et al., "Broadband quasi-taper helical antennas," IEEE Transactions on Antennas and Propagation, Jan. 1979, pp. 72-78, vol. AP-27, No 1.
Liu et al., "An origami reconfigurable axial-mode bifilar helical antenna," IEEE Transactions on Antennas and Propagation, 2015, pp. 5897-5903, vol. 63, No. 12.
Liu et al., "Reconfigurable origami equiangular conical spiral antenna," IEEE International Symposium on Antennas and Propagation, APSURSI, 2015, pp. 2263-2264.
(Continued)

*Primary Examiner* — Dameon E Levi
*Assistant Examiner* — Hasan Islam
(74) *Attorney, Agent, or Firm* — Saliwanchik, Lloyd & Eisenschenk

(57) ABSTRACT

Disclosed herein are polarization and frequency reconfigurable origami-folded antennas and methods for making the same. An origami-folded antenna can include at least one ground plane that can include a dielectric stratum and a conductive stratum that is at least partially disposed on the conductive stratum. The origami-folded antenna can further include at least two helical sections that can include a dielectric sheet and a conductive sheet. The origami-folded antenna can be expanded to an expanded state and compressed to a compressed state along a center axis, and the antenna can have a greater length along the center axis when in the expanded state than when in the compressed state.

10 Claims, 33 Drawing Sheets

(56) References Cited

OTHER PUBLICATIONS

Onal et al., "Origami-inspired printed robots," IEEE/ASME Transactions on Mechatronics, 2015, pp. 2214-2221, vol. 20, No. 5.
Abadi et al., "Exploiting mechanical flexure as a means of tuning the responses of large-scale periodic structures," IEEE Transactions on Antennas and Propagation, Mar. 2016, pp. 933-943, vol. 64, No. 3.

* cited by examiner

FIG. 27

| | Unfolded State | | Semi-folded State | | Folded State | |
|---|---|---|---|---|---|---|
| | Origami large uniform helix | Origami folded antenna | Origami large uniform helix | Origami folded antenna | Origami large uniform helix | Origami folded antenna |
| Three States of two Antennas | 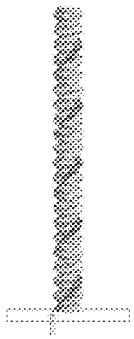 | 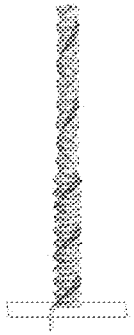 | 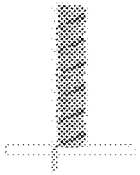 | 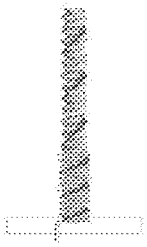 | 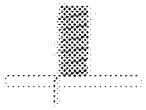 | 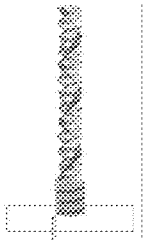 |
| Bandwidth with ±1 dB RHCP Gain Variation from the Maximum | 1.3 GHz-1.78 GHz | 1.2 GHz-1.84 GHz | 1.76 GHz-3.34 GHz | 1.66 GHz-3.44 GHz | Not CP | 2.54 GHz-3.6 GHz |
| Fractional Bandwidth Δf with ±1dB RHCP Gain Variation from the Maximum | Δf=31.2% | Δf=42.1% | Δf=62% | Δf=69.8% | Not CP | Δf=34.5% |
| Maximum RHCP Gain | 7.2 dB | 6.4 dB | 13 dB | 12.2 dB | Not CP | 12.8 dB |
| AR Range | 1.2 dB-2.7 dB | 0.6 dB-2.2 dB | 0.1 dB-2.1 dB | 0.1 dB-2.9 dB | >3 dB | 0.4 dB-2.5 dB |

FIG.28

| Antennas | Standard Monofilar | Standard Multi-radii Monofilar | Origami Folded Antenna |
|---|---|---|---|
| Geometry | 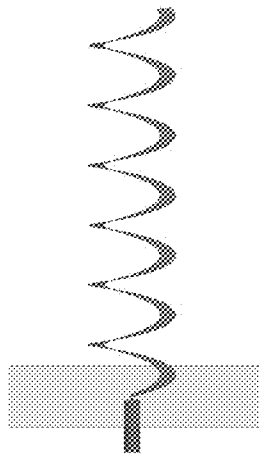 | 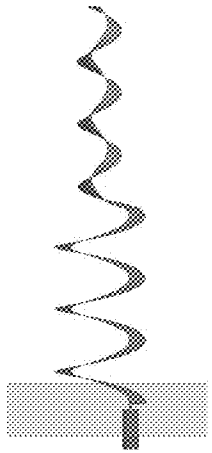 | 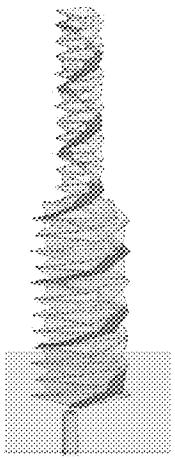 |
| S11 Bandwidth (S11<-16 dB) | 2.86 GHz-3.67 GHz (Δf=24.8%) | 2.5 GHz-5 GHz (Δf=66.7%) | 2.31 GHz-4.66 GHz (Δf=67.4%) |
| Bandwidth with ±1dB RHCP Gain Variation from the Maximum | 1.94 GHz-3.4 GHz (Δf=54.7%) | 2.44 GHz-3.66 GHz (Δf=40%) | 1.96 GHz-3.46 GHz (Δf=55.4%) |
| Maximum RHCP Gain during CP Bandwidth | 13.5 dB | 13.8 dB | 13.2 dB |
| Maximum Side Lobe Level at fc | 2.4 dB | -0.9 dB | 0.2 dB |
| AR Range | 0.41 dB-2.32 dB | 0.17 dB-1.22 dB | 0.18 dB-1.89 dB |
| Frequency Band Reconfigurability in 3 States | No | No | Yes |

FIG. 29

| pitch | Bandwidth with ±1dB RHCP Gain Variation from the Maximum | Fractional Bandwidth Δf with ±1dB RHCP Gain Variation from the Maximum | Maximum RHCP Gain | AR Range |
|---|---|---|---|---|
| 20 mm | 2.48 GHz-3.66 GHz | Δf=38.4% | 13.9 dB | 0.2 dB-1.9 dB |
| 31.3 mm | 1.92 GHz-3.53 GHz | Δf=59.1% | 13 dB | 0.3 dB-2.3 dB |
| 60 mm | 1.76 GHz-2.12 GHz | Δf=18.6% | 9.8 dB | 0.7 dB-2.6 dB |

FIG. 30

| $pitch_1$ | Bandwidth with ±1dB RHCP Gain Variation from the Maximum | Fractional Bandwidth Δf with ±1dB RHCP Gain Variation from the Maximum | Maximum RHCP Gain | AR Range |
|---|---|---|---|---|
| 16 mm | 2.4 GHz-3.1 GHz | Δf=25.5% | 12.5 dB | 0.6 dB-3 dB |
| 32 mm | 1.96 GHz-3.48 GHz | Δf=55.9% | 13.2 dB | 0.5 dB-2.9 dB |
| 50 mm | 1.96 GHz-3.44 GHz | Δf=54.8% | 13.2 dB | 0.1 dB-1.2 dB |
| 65.6 mm | 1.72 GHz-3.52 GHz | Δf=68.7% | 12.5 dB | 0.1 dB-1.4 dB |
| 75.2 mm | 1.74 GHz-3.48 GHz | Δf=66.7% | 12.6 dB | 0.2 dB-1 dB |

FIG. 31

| $f_{scale}$ | Bandwidth with ±1dB RHCP Gain Variation from the Maximum | Fractional Bandwidth Δf with ±1dB RHCP Gain Variation from the Maximum | Maximum RHCP Gain | AR Range |
|---|---|---|---|---|
| 0.4 | 1.94 GHz-3.52 GHz | Δf=57.9% | 11.4 dB | 0.4 dB-2.9 dB |
| 0.8 | 1.96 GHz-3.5 GHz | Δf=56.4% | 13.2 dB | 0.2 dB-2.4 dB |
| 1.2 | 1.64 GHz-2.72 GHz | Δf=49.5% | 13 dB | 0.1 dB-2.9 dB |

FIG. 32

| m | Bandwidth with ±1dB RHCP Gain Variation from the Maximum | Fractional Bandwidth Δf with ±1dB RHCP Gain Variation from the Maximum | Maximum RHCP Gain | AR Range |
|---|---|---|---|---|
| 6 | 2.2 GHz-3.08 GHz | Δf=33.3% | 11 dB | 0.1 dB-2.9 dB |
| 18 | 1.94 GHz-3.46 GHz | Δf=56.3% | 12.7 dB | 0.4 dB-3 dB |
| 30 | 1.92 GHz-3.34 GHz | Δf=54% | 13.7 dB | 0.3 dB-2.4 dB |

FIG. 33

| $m_1$ | Bandwidth with ±1dB RHCP Gain Variation from the Maximum | Fractional Bandwidth Δf with ±1 dB RHCP Gain Variation from the Maximum | Maximum RHCP Gain | AR Range |
|---|---|---|---|---|
| 0 | 1.94 GHz-3.26 GHz | Δf=50.8% | 11.1 dB | 0.7 dB-2.7 dB |
| 6 | 1.94 GHz-3.5 GHz | Δf=57.4% | 11.6 dB | 0.3 dB-3 dB |
| 18 | 1.94 GHz-3.46 GHz | Δf=56.3% | 12.7 dB | 0.4 dB-3 dB |
| 30 | 2.04 GHz-3.42 GHz | Δf=50.5% | 13.5 dB | 0.5 dB-1.9 dB |

ORIGAMI-FOLDED ANTENNAS AND METHODS FOR MAKING THE SAME

STATEMENT OF GOVERNMENT SUPPORT

The subject invention was made with government support under a research project supported by the National Science Foundation (NSF), Grant No. 1332348. The government has certain rights in the invention.

BACKGROUND OF INVENTION

Deployable antennas, which can be compressed and expanded, can be useful for many applications, such as satellite communications. In such applications, it is important for the antenna to be able to fit into a small space and, then, be able to expand to an operational size once orbit is reached. While the sensors and operating electronics of satellites can be scaled to small volumes, the wavelengths of the signals used by miniaturized satellites to communicate do not scale accordingly. Given that the wavelength of a signal determines the size of an antenna needed to communicate that signal, antennas for miniaturized satellites still must have dimensions similar to those for larger satellites. Because of these size limitations for deployable antennas, some of the advantages of satellite miniaturization remain unrealized.

Origami folding techniques have been applied in many technical areas, such as antennas [1, 2, 3, 4], robotics [5], and electromagnetics [6]. Circuits and electronic elements can be integrated into a planar form and, then, folded into three-dimensional structures by using origami folding techniques. These origami-folded structures make it possible to design reconfigurable and expandable components for deployable antennas. However, there still remain challenges in making deployable antennas that can balance stowability and reconfigurability with their operational requirements.

BRIEF SUMMARY

Because there is a need for new deployable antennas that can occupy small volumes prior to use and, then, be expandable upon deployment, origami-folded antennas and methods for making the same are provided herein. In at least one specific embodiment, the origami-folded antenna can include one or more ground planes that can include a dielectric stratum and a conductive stratum, where the dielectric stratum is at least partially disposed on the conductive stratum. The origami-folded antenna can further include two or more helical sections that can include a dielectric sheet and a conductive sheet having a first end and a second end, where the conductive sheet is at least partially disposed on the dielectric sheet, where the dielectric sheet is folded into one or more folded segments to make two or more helical sections connected in a series having an elongated center axis, where the conductive sheet defines an electrical current path from the first end of the conductive sheet to the second end of the conductive sheet, and where the folded segments can include creases that are transverse to the center axis of the helical section. The origami-folded antenna can further include one or more feed lines. The origami-folded antenna can be expanded to an expanded state and compressed to a compressed state along a center axis, and where the antenna has a greater length along the center axis when in the expanded state than when in the compressed state.

In another specific embodiment, the origami-folded antennas can include two or more helical sections that can include a dielectric sheet and a conductive sheet having a first end and a second end, where the conductive sheet is at least partially disposed on the dielectric sheet, where the dielectric sheet is folded into one or more folded segments to make a cylindrical shape, where the conductive sheet defines an electrical current path from the first end of the conductive sheet to the second end of the conductive sheet, and where the folded segments have creases that are transverse to a center axis of the helical section.

In another specific embodiment, the method of making an origami-folded antenna can include the steps of: disposing a dielectric stratum onto a conductive stratum to make a ground plane; disposing a conductive sheet onto a dielectric sheet, where the conductive sheet defines an electrical current path from a first end of the conductive sheet to a second end of the conductive sheet; folding the dielectric sheet into one or more folded segments to make two or more helical sections connected in a series, where each helical section comprises a cylinder shape, where the folded segments have creases that are transverse to a center axis of the cylindrical shape, where each helical section can be expanded or compressed along the center axis of the cylindrical shape, and where each helical section has a greater length along the center axis when expanded than when compressed; and attaching a first helical section to the ground plane, where the origami-folded antenna has a greater length along a center axis when in the expanded state than when in the compressed state.

BRIEF DESCRIPTION OF THE DRAWINGS

In the following detailed description, reference is made to the accompanying figures, depicting exemplary, non-limiting, and non-exhaustive embodiments of the invention. So that the manner in which the above recited features of the present invention can be understood in detail, a more particular description of the invention, briefly summarized above, can be had by reference to the embodiments, some of which are illustrated in the appended figures. It should be noted, however, that the appended figures illustrate only some embodiments of this invention and are therefore not to be considered limiting of its scope, for the invention can admit to other equally effective embodiments. Like numbers indicate like parts throughout the figures. Unless otherwise specifically indicated in the disclosure that follows, the figures are not necessarily drawn to scale.

FIG. 12A shows the plot of the reflection coefficient $S_{11}$ for state one (expanded state). FIG. 12B shows the plot of the reflection coefficient $S_{11}$ for state two (semi-expanded state). FIG. 12C shows the plot of the reflection coefficient $S_{11}$ for state three (compressed state).

FIG. 13A shows the plot of the axial ratio for state one (expanded state). FIG. 13 B shows the plot of the axial ratio for state two (semi-expanded state). FIG. 13 C shows the plot of the axial ratio for state three (compressed state).

FIG. 14A shows the right-hand circularly polarized realized gain for state one (expanded state). FIG. 14B shows the right-hand circularly polarized realized gain for state two (semi-expanded state). FIG. 14C shows the right-hand circularly polarized realized gain for state three (compressed state).

FIG. 15 shows the radiation pattern for the expanded state of height and/or length along a central axis of an origami-folded antenna 100 at 1.64 GHz. FIG. 16 shows the radiation pattern for the semi-expanded state of height and/or length along a central axis of an origami-folded antenna 100 at 3.38 GHz. FIG. 17 shows the radiation pattern for the compressed state of height and/or length along a central axis of an origami-folded antenna 100 at 4.04 GHz.

FIG. 27 shows the comparison of a six-turn origami-folded antenna with one uniform helical section and an origami-folded antenna 100.

FIG. 28 shows the comparison of a standard monofilar antenna, a standard multi-radii monofilar, and an origami-folded antenna 100.

FIG. 29 shows that there is an optimal pitch (i.e., pitch=31.3 mm) that provides the widest bandwidth with +1 dB RHCP gain variation from the maximum RHCP gain.

FIG. 30 shows as the $pitch_1$ increases the maximum AR in the gain bandwidth has a trend to decrease, and there is an optimal $pitch_1$ (i.e., $pitch_1$=65.6 mm) that provides the widest bandwidth with +1 dB RHCP gain variation from the maximum.

FIG. 31 shows how the $f_{scale}$ (i.e., $a_1$) can be selected to properly optimize the trade-off between maximum RHCP gain and gain bandwidth with +1 dB RHCP gain variation from the maximum.

FIG. 32 shows that when m increases, the maximum RHCP gain increases, while the gain bandwidth (calculated from the frequencies that exhibit gain within +1 dB from the maximum gain) first increases and then starts decreasing.

FIG. 33 shows that when $m_1$ increases, the maximum RHCP gain increases, while the gain bandwidth (calculated from the frequencies that exhibit gain within +1 dB from the maximum gain) first increases and then starts decreasing.

DETAILED DISCLOSURE

The origami-folded antennas disclosed herein are compressible for good stowability and expandable to an operational size while maintaining effective operating properties.

The origami-folded antennas can also be tunable. For example, the gain of the origami-folded antennas can be tuned to specific frequencies by adjusting the amount of expansion of the antennas between a compressed state and an expanded state. The origami-folded antennas can be used for applications in the L band and S band, such as GPS, WiMAX, and satellite communications.

The circularly polarized antennas are useful in various applications, such as, satellite and space communications because they can receive EM waves with different polarizations. Moreover, wide-band and frequency tunable antennas are useful because they can cover different operating bands eliminating the need of multiple antennas.

The origami-folded antenna 100 can have many different geometries and configurations. FIGS. 1, 2, 4, and 6-11 show specific embodiments of the origami-folded antenna 100. The origami-folded antenna 100 can include, but are not limited to, one or more ground planes 102, one or more helical sections 104, one or more feed lines 106, and, optionally, one or more transmitters and/or receivers (not shown). The origami-folded antenna 100 can be a monofilar helical antenna.

Figure 7B:
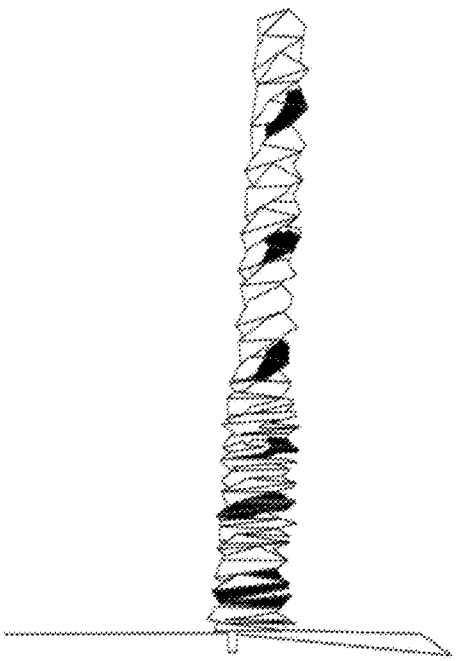
FIG. 7B is photograph of a semi-expanded or second state of height or length along the central axis of an origami-folded antenna 100.
Figure 7A:
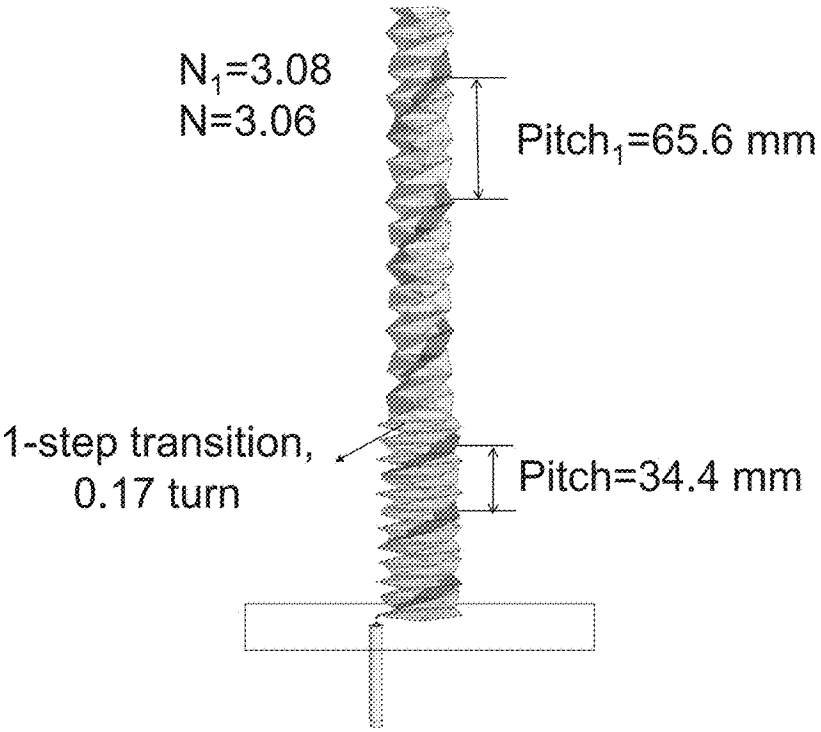
FIG. 7A is a schematic view for a semi-expanded or a second state of height or length along the central axis of an origami-folded antenna 100.
Figure 8B:
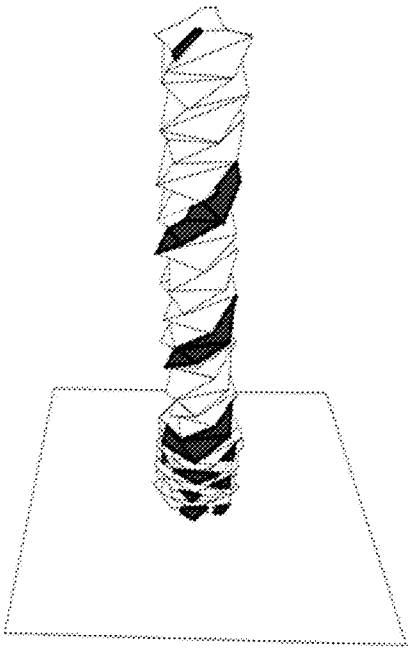
FIG. 8B is photograph of a compressed state or a third state of height of height or length along the central axis of an origami-folded antenna 100.
Figure 8A:
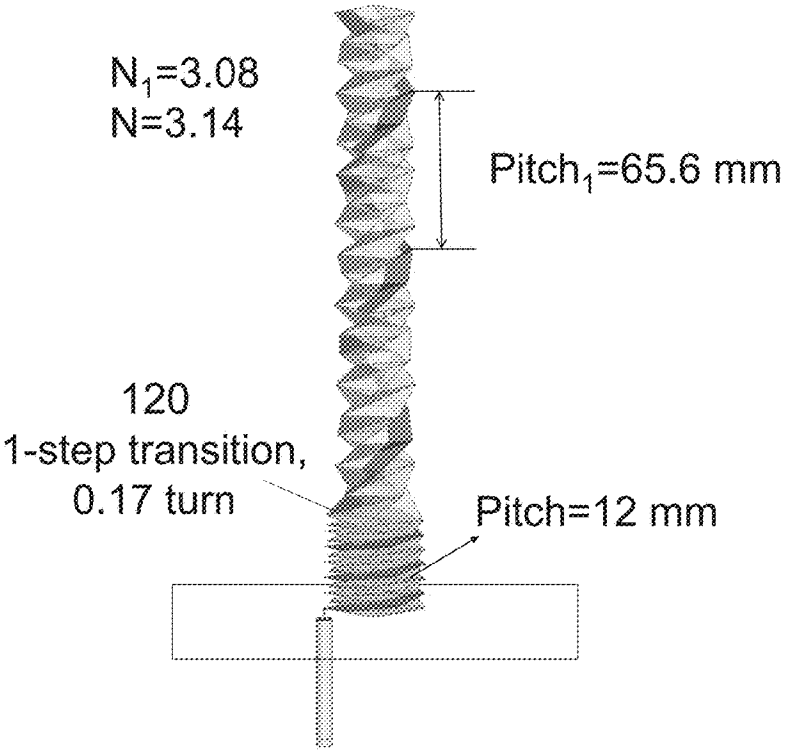
FIG. 8A shows a compressed state (i.e., state with the smallest height out of the three states) or a third state of height or length along the central axis of an origami-folded antenna 100.
Figure 9:
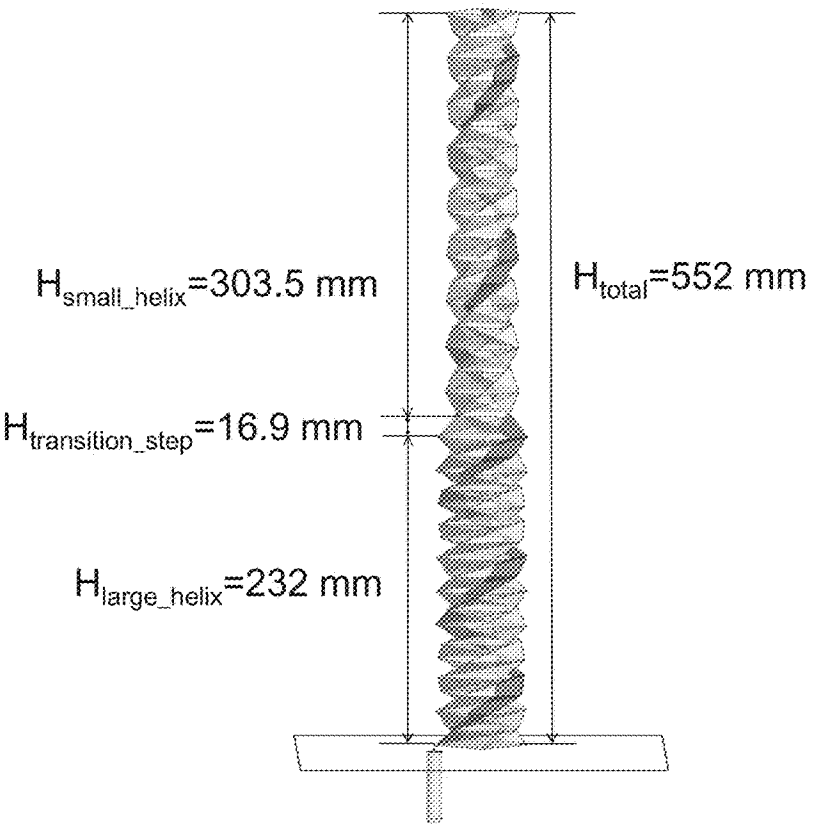
FIG. 9 shows the height and/or length along the central axis of each helical section 104, including a transition section 120 between the helical sections 104, and the total height and/or length along the central axis of the origami-folded antenna 100 in its expanded state.
Figure 10:
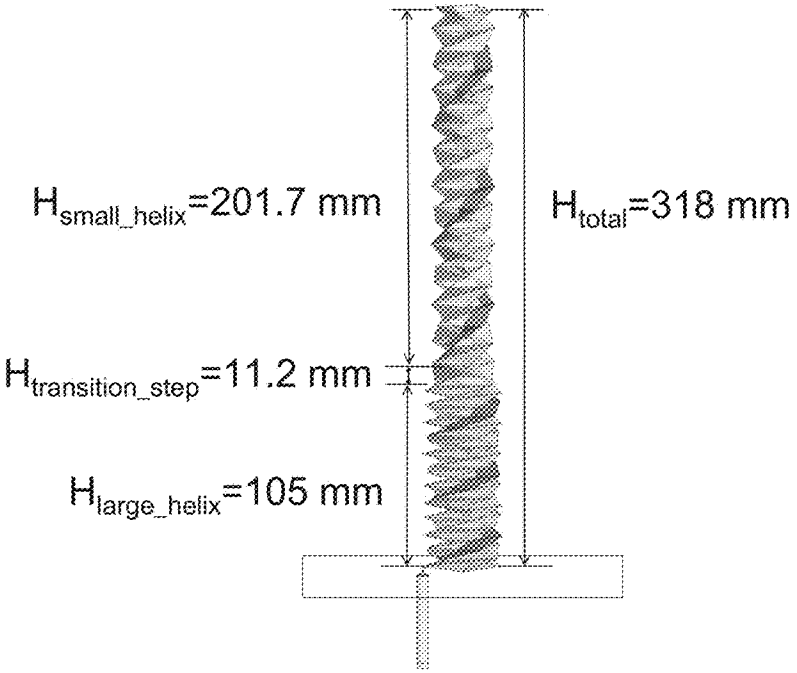
FIG. 10 shows the height and/or length along the central axis of each helical section 104, including a transition section 120 between the helical sections 104, and the total height and/or length along the central axis of the origami-folded antenna 100 in its semi-expanded state.
Figure 11:
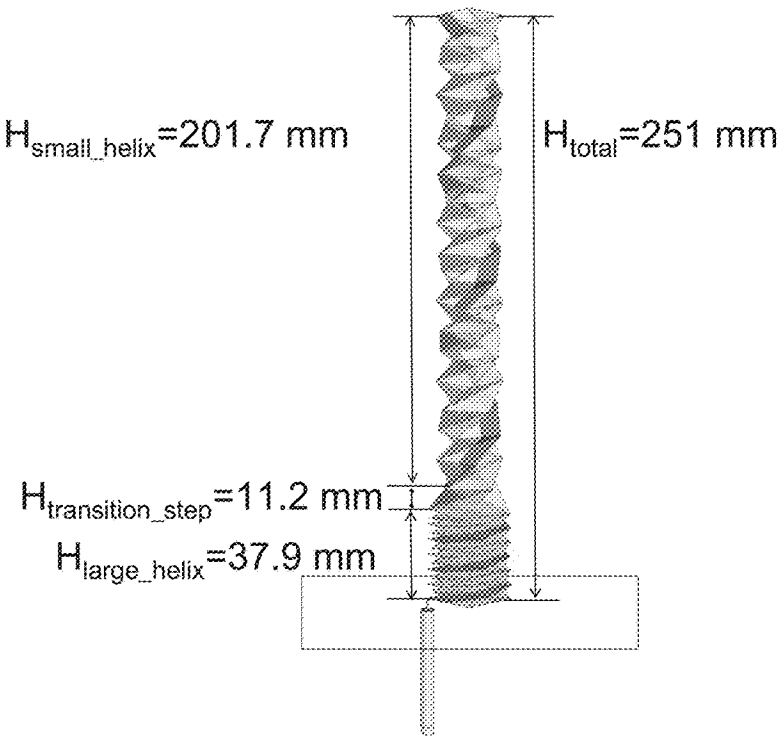
FIG. 11 shows the height and/or length along the central axis of each helical section 104, including a transition section 120 between the helical sections 104, and the total height and/or length along the central axis of the origami-folded antenna 100 when one of the helical sections 104 is in a compressed state.

The origami-folded antenna 100 can be configured to many states of height and/or length along a central axis. The origami-folded antenna 100 can have a greater height and/or length along the central axis when in the expanded state of height than when in the compressed state of height. In FIGS. 6-11, an origami-folded antenna 100 is shown in three states of height, i.e., state one or expanded, state two or semi-expanded, and state three or compressed. The compressed state of height and/or length along a central axis for the origami-folded antenna 100 can vary widely. For example, the compressed state of height and/or length along a central axis for the origami-folded antenna 100 can be from a short of about 1 mm, 20 mm, or 45 mm to a long of about 77.5 mm, about 90 mm, or about 10 cm. In another example, the compressed state of height and/or length along a central axis for the origami-folded antenna 100 can be from about 1 mm to about 10 mm, about 10 mm to about 500 mm, about 30 mm to about 20 cm, about 38 mm to about 77.5 mm, about 50 mm to about 150 mm, or about 1 cm to about 10 cm. FIGS. 8A-B show a compressed state of height for an origami-folded antenna 100 of about 251 mm.

The semi-expanded state of height and/or length along a central axis for the origami-folded antenna 100 can vary widely. For example, the semi-expanded state of height and/or length along a central axis for the origami-folded antenna 100 can be from a short of about 10 mm, 30 mm, or 45 mm to a long of about 300 mm, about 500 mm, or about 15 cm. In another example, the semi-expanded state of height and/or length along a central axis for the origami-folded antenna 100 can be from about 10 mm to about 20 cm, about 20 mm to about 500 mm, about 38 mm to about 50 cm, about 38 mm to about 77.5 mm, or about 1 cm to about 15 cm. FIGS. 7A-B show a semi-expanded state of height for an origami-folded antenna 100 of about 318 mm.

Figure 6B:
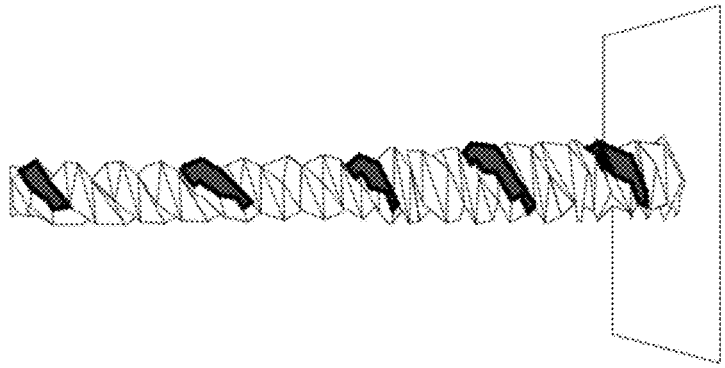
FIG. 6B is photograph of a first state of height or length along the central axis of an origami-folded antenna 100.
Figure 6A:
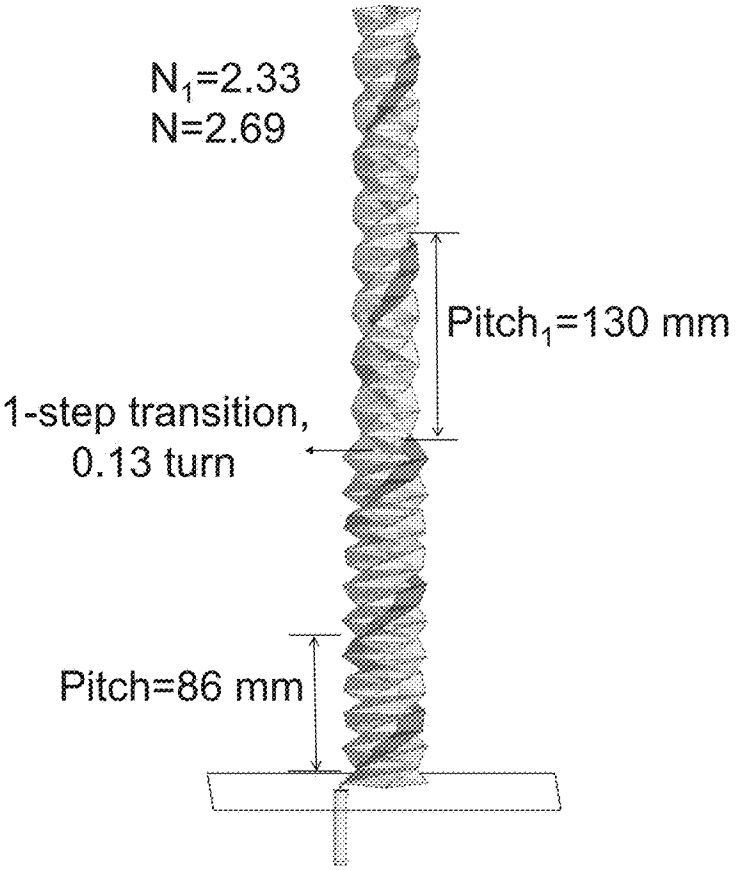
FIG. 6A is a schematic view for an expanded or a first state of height or length along the central axis of an origami-folded antenna 100. The pitches of the small helical section 104 and large helical section 104 are $pitch_1$ and pitch, respectively.

The expanded state of height and/or length along a central axis for the origami-folded antenna 100 can vary widely. For example, the expanded state of height and/or length along a central axis for the origami-folded antenna 100 can be from a short of about 20 mm, 30 mm, or 45 mm to a long of about 300 mm, about 500 mm, or about 35 cm. In another example, the expanded state of height and/or length along a central axis for the origami-folded antenna 100 can be from about 10 mm to about 20 cm, about 20 mm to about 500 mm, about 38 mm to about 50 cm, about 38 mm to about 77.5 mm, or about 1 cm to about 35 cm. FIGS. 6A-B show an expanded state of height and/or length along a central axis for an origami-folded antenna 100 of about 552 mm.

The state of height and/or length along a central axis for the origami-folded antenna 100 can be selected to achieve a directional radiation in reconfigurable frequency bands. For example, the height and/or length along a central axis of the origami-folded antenna 100 can be adjusted by the user pushing down on the helical sections 104. The origami-folded antenna 100 can have operating bandwidths that vary widely. For example, the origami-folded antenna 100 can have an operating bandwidths from a low of about 1 GHz, about 1.2 GHz, 1.3 GHz to a high of about 4 GHz, about 6 GHz, or about 8 GHz. For example, the origami-folded antenna 100 can have operating bandwidths from about 1 GHz to about 5 GHz, about 1.1 GHz to about 4.8 GHz, about 1.28 GHz to about 4.12 GHz, 1.38 GHz to about 4.26 GHz about 1.5 GHz to about 3.5 GHz, or about 1.6 GHz to about 6 GHz when proper number and sizes of radii are designed. In another example, origami-folded antenna 100 can have different operating bandwidths for different states of height. For example, the origami-folded antenna 100 can have measured CP bandwidths from about 1.38 GHz to about 3.6 GHz (fractional bandwidth $\Delta f$=89.2%) for a state of height of 552 mm, about 1.72 GHz to about 3.86 GHz ($\Delta f$=76.7%) for a state of height of 318 mm, and about 2.06 GHz to about 3.64 GHz ($\Delta f$=55.4%) for a state of height of 251 mm, as shown in FIGS. 13 A-C where AR<3 dB and are illustrated with red shades in FIGS. 14 A-C. Any of the values provided herein that have "about" in front of them could also be stated without the word "about"—e.g., the origami-folded antenna 100 can have operating bandwidths from 1 GHz to 5 GHz, 1.1 GHz to 4.8 GHz, 1.28 GHz to 4.12 GHz, 1.5 GHz to 3.5 GHz, or 1.6 GHz to 6 GHz.

Figure 14A:
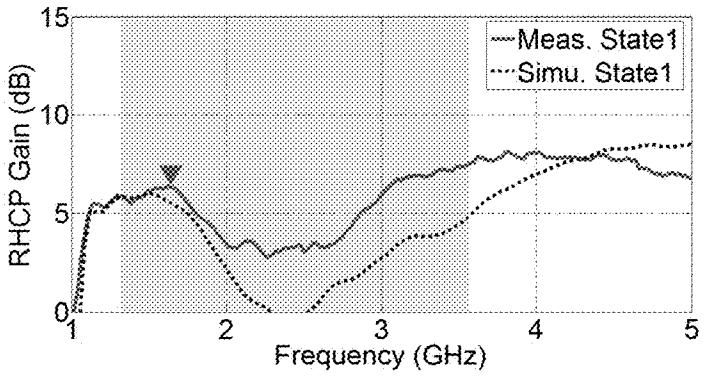
FIGS. 14A-C are plots of the right-hand circularly polarized (RHCP) realized gain with respect to frequency for the three states of height and/or length along a central axis of an origami-folded antenna 100.
Figure 14B:
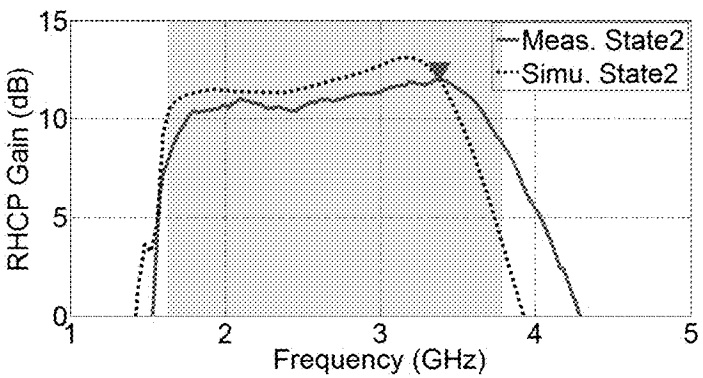
Figure 14C:
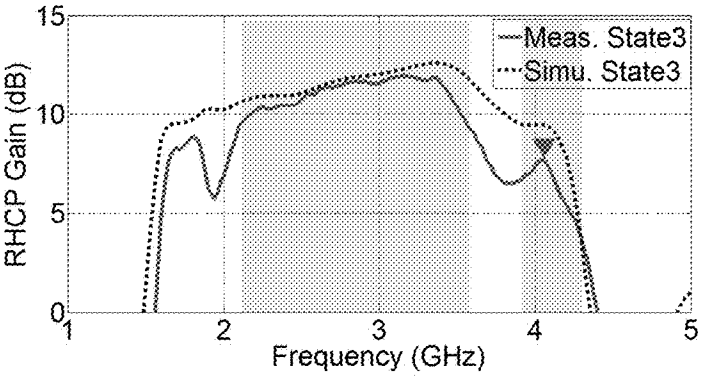

The origami-folded antenna 100 can have a realized gain that varies widely. For example, the origami-folded antenna 100 can have a realized from a low of about 2 dB, about, 4 dB, or about 6 dB to a high of about 10 dB, about 15 dB, or about 30 dB. In another example, the origami-folded antenna 100 can have a measured maximum RHCP realized gain at three states of antenna height in their operating frequency bands respectively about 7.6 dB at state of height of about 552 mm, about 12 dB at state of height of about 318 mm, and about 11.9 dB at state of height of about 251 mm, as shown in FIGS. 14 A-C. The realized gain of the origami-folded antenna 100 can be increased in many ways. For example, the realized gain of the origami-folded antenna 100 can be increased by increasing the number of turns of the helical sections 104, by using a reflector, and by using an array of origami-folded antennas 100.

The origami-folded antenna 100 can have an axial ratio that varies widely by tuning the height of small helix. For example, the origami-folded antenna 100 can have an axial ratio from a low of about 0.1 dB, about 1 dB, or about 2 dB to a high of about 4 dB, about 5 dB, or about 8 dB for an operating frequency bands from about 1 GHz to about 5 GHz. In another example, origami-folded antenna 100 can have an axial ratio from about 0.1 dB to about 1 dB, about 0.5 dB to about 2 dB, about 2 dB to about 3 dB, about 3 dB to about 4 dB for an operating frequency band from about 1 GHz to about 5 GHz.

Therefore, the origami-folded antenna 100 can have different kinds of polarizations at the various states of height and/or lengths along a central axis. For example, the origami-folded antenna 100 can have right-hand circular polarization (RHCP)/left-hand circular polarization (LHCP), linear polarization, and elliptical polarization in its operating frequency bands. For example, the origami-folded antenna 100 can have measured right-hand circular polarization at a height of about 318 mm from about 1.72 GHz to about 3.86 GHz with a fractional circular polarization bandwidth of about 76.7% in a semi-expanded state.

The ground plane 102 can include, but is not limited to, one or more dielectric strata 108 and one and more conductive strata 110. The ground plane 102 can include, but are not limited to, a square, planar, parallelogram, circular, and rectangular shape. The ground plane 102 can have a top and a bottom.

The side lengths of the ground plane 102 can widely vary. For example, the side lengths of the ground plane 102 can be from a short of about 50 mm, about 75 mm, or about 100 mm to a long of about 200 mm about 300 mm, and about 400 mm, and can be optimized for operating frequencies. In another example, the side lengths of the ground plane 102 can be from 50 mm to about 400 mm, about 55 mm to about 120 mm, about 65 mm to about 200 mm, about 100 mm to about 300 mm, about 125 mm to about 320 mm, or about 200 mm to about 390 mm.

The dielectric stratum 108 can include, but are not limited to, a square, planar, parallelogram, circular rectangular shape. The dielectric stratum 108 can have a top and a bottom. The side lengths of the dielectric stratum 108 can widely vary. For example, the side lengths of the dielectric stratum 108 can be from a short of about 50 mm, about 75 mm, or about 100 mm to a long of about 200 mm, about 300 mm, or about 400 mm. In another example, the side lengths of the dielectric stratum 108 can be from 50 mm to about 400 mm, about 55 mm to about 120 mm, about 65 mm to about 200 mm, about 100 mm to about 300 mm, about 125 mm to about 320 mm, or about 200 mm to about 390 mm.

The conductive stratum 110 can include, but are not limited to, a square, planar, parallelogram, circular rectangular shape. The conductive stratum 110 can have a top and a bottom. The side lengths of the conductive stratum 110 can widely vary. For example, the side lengths of the conductive stratum 110 can be from a short of about 50 mm, about 75 mm, or about 100 mm to a long of about 200 mm, about 3 mm, and about 400 mm. In another example, the side lengths of the conductive stratum 110 can be from 50 mm to about 400 mm, about 55 mm to about 120 mm, about 65 mm to about 200 mm, about 100 mm to about 300 mm, about 125 mm to about 320 mm, or about 200 mm to about 390 mm.

The bottom of the dielectric stratum 108 can be attached or disposed on the top of the conductive stratum 110 to form a layered structure. The dielectric stratum 108 can be attached to the conductive stratum 110 by any means. For example, the dielectric stratum 108 can be glued, taped, printed, fastened, screwed or bolted on to at least portion of the conductive stratum 110.

The dielectric stratum 108 can include one or more dielectric materials. The dielectric stratum 108 can include any dielectric material that is both sufficiently conductive for antenna applications and is compatible with the conductive stratum 110. For example, the dielectric stratum 108 can include, but is limited to: ceramic, paper, such as sketching-paper, cardboard, plastic, polymer, resin, glass, and combinations thereof. The conductive stratum 110 can include one or more electrical conductive materials. For example, the conductive stratum 110 can include, but is not limited to: metal, including copper, silver, gold, aluminum, brass, zinc nickel, iron, tin, steel, lead, nickel, metal oxide, and alloy; polymer; and any combinations thereof. The dielectric stratum 108 of the ground plane 102 and the dielectric sheet of the helical section 104 can be made from the same material or from different kinds of materials.

The helical sections 104 can include, but are not limited to, one or more dielectric sheets 114 and one or more conductive sheets 116. Different sizes and shapes of the dielectric sheets 114 can be used to achieve different antenna characteristics and performances. The dielectric sheet 114 can have a top and a bottom. The dielectric sheets 114 can have a width from a short of about 15 mm to a long of about 7.5 cm. For example, the dielectric sheets 114 can have a width from about 16 mm to about 7.2 cm, about 18 mm to about 40 mm, about 20 mm to about 50 mm, about 25 mm to about 5 cm, about 28 mm to about 4.5 cm, or about 30 mm to about 6.5 cm.

The dielectric sheet 114 can include, but is not limited to: ceramic, paper, such as sketching-paper, cardboard, plastic, polymer, resin, glass, and combinations thereof. The dielectric sheets 114 of the helical sections 104 and the dielectric stratum 108 of the ground plane 102 can be made from the same material or different kinds of materials.

Different sizes and shapes of the conductive sheet 116 can be used to achieve different antenna characteristics and performance. The conductive sheet 116 can have a top and a bottom. The conductive sheet 116 can have a first and a second end that defines an electrical current path. The conductive sheets 116 can have a width from a short of about 15 mm, about 50 mm, or about 100 mm to a long of about 1 cm, about 4 cm, or about 7.5 cm. For example, the conductive sheets 116 can have a width from about 16 mm to about 7.2 cm, about 18 mm to about 40 mm, about 20 mm to about 50 mm, about 25 mm to about 5 cm, about 28 mm to about 4.5 cm, or about 30 mm to about 6.5 cm. The conductive sheets 116 can change its width from each helical section 104 connected in series.

The conductive sheets 116 can include any material that is both sufficiently conductive for antenna applications and that is compatible with the dielectric sheets 116. The conductive sheet 116 can include, but is not limited to: metal, including copper, silver, gold, aluminum, brass, zinc nickel, iron, tin, steel, lead, nickel, metal oxide, 3-d printing conductive filament, and alloys; polymer; and any combination thereof. The conductive sheet 116 of the helical sections 104 and the conductive stratum 110 of the ground plane 102 can be made from the same material or different kinds of material.

Figure 4:
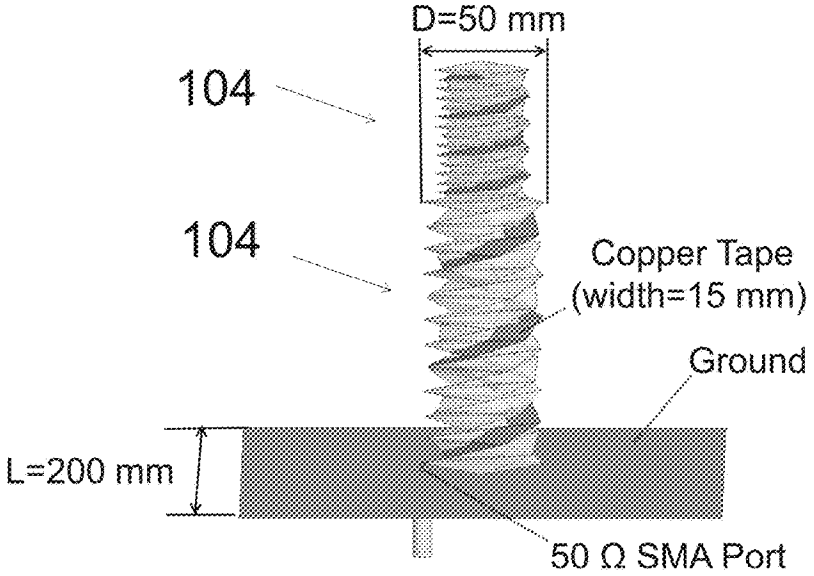
FIG. 4 is a schematic view of an embodiment of an origami-folded antenna 100 with two helical sections 104.

The dielectric sheets 114 can have the conductive sheet 116 attached and/or disposed on at least a portion of the dielectric sheet 116. In FIG. 4, the conductive sheet 116, e.g., copper tape, is attached along an edge portion of the dielectric sheet 114. The conductive sheets can be attached to the dielectric sheet 114 by any means. For example, the conductive sheets can be attached to the dielectric sheet 114 by gluing, taping, printing, fastening, screwing or bolting.

Figure 1:
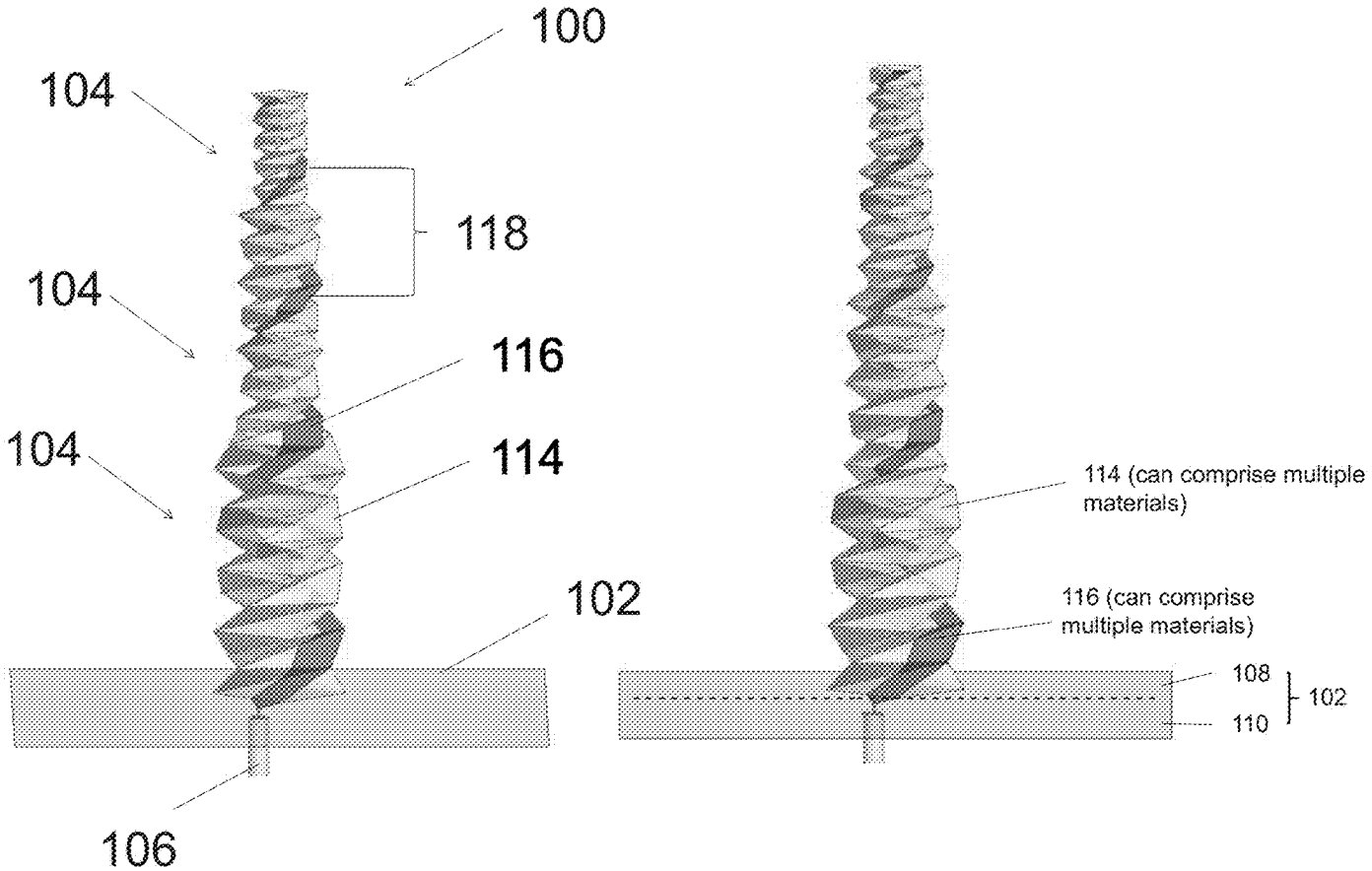
FIG. 1 shows a schematic view of two side-by-side embodiments of origami-folded antennas 100 with three and/or four helical sections in their expanded state. The conductive sheets 116 are shown in orange and the dielectric sheets 114 are shown in white.
Figure 2:
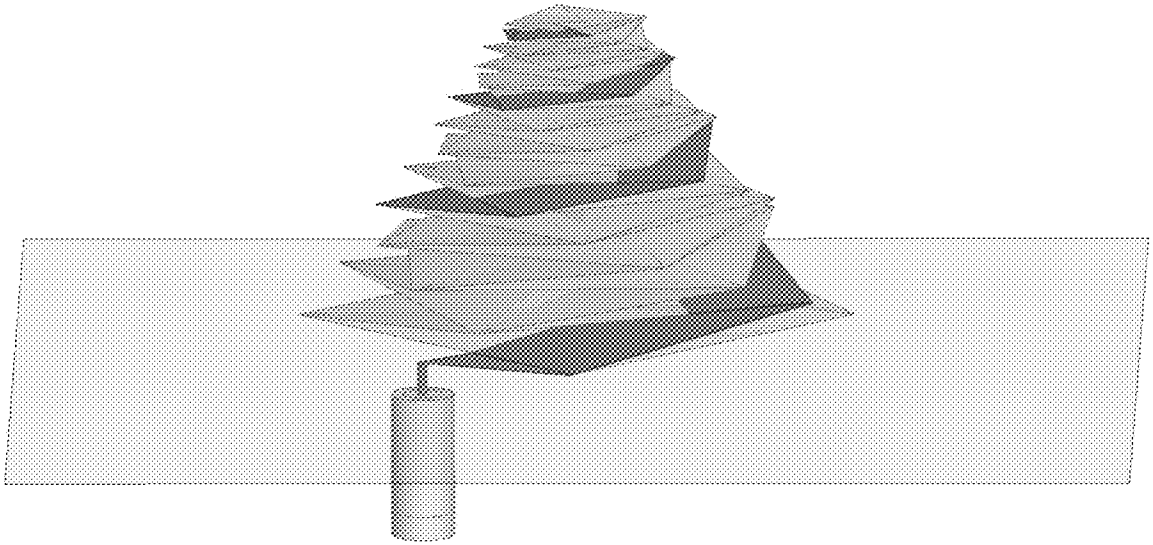
FIG. 2 shows a schematic view of an embodiment of a conical origami-folded antenna 100 in its compressed state.
Figure 3:
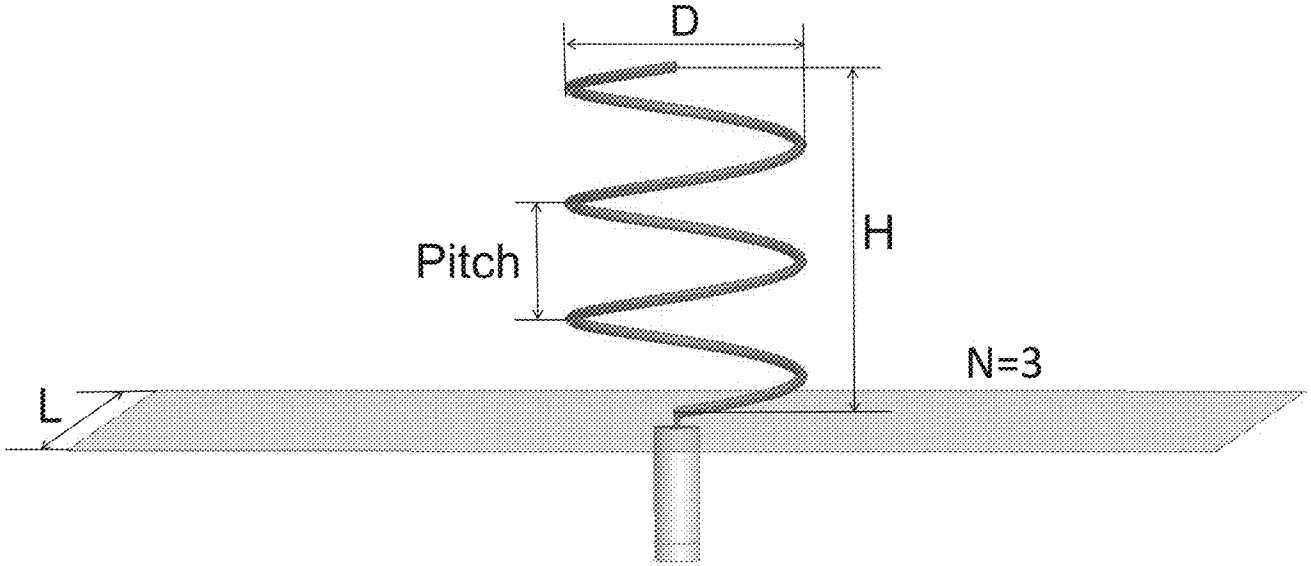
FIG. 3 illustrates definitions of geometric parameters in a standard helical antenna. These definitions are the same for the origami-folded antenna 100. D is the diameter of the helical section 104, pitch is the distance between two adjacent helical turns 118 of the helical section 104, H is the annotated height of the helical section 104, N is the total number of helical turns 118 of the helical section 104, and L is the side length of a square ground plane 102.

The helical sections 104 can include, but are not limited to, a three-dimensional structure composed of folded segments 112 of the dielectric sheets 114. The origami-folded antenna 100 can have one, two, three, four, five, or more helical sections 104. The embodiments shown in FIGS. 4 and 6-11 have two helical sections 104. The helical sections 104 can include, but is not limited to, a cylindrical shape, a cone shape, and/or a conical shape. A helical section 104 with a conical shape is shown in FIG. 2. The helical sections 104 can have a first end and a second end. The helical sections 104 can be attached to one another at their ends. In other words, the helical sections 104 can be connected in a series. The helical sections 104 can be attached or positioned transverse to the ground plane 102. For example, the helical sections 104 can extend vertically from approximately the center of the horizontal ground plane 102.

The folded segments 112 can include, but is not limited to, creases that lie transverse to the center axis of the helical section 104 and/or origami-folded antenna 100. The conductive sheet 116 can form an electrical current path from the feed line 106 to the top of the upper most helical section 104. The conductive sheet 116 can be arranged so that the each of the folded segments 112 includes a portion of the dielectric sheet 116.

Figure 5:
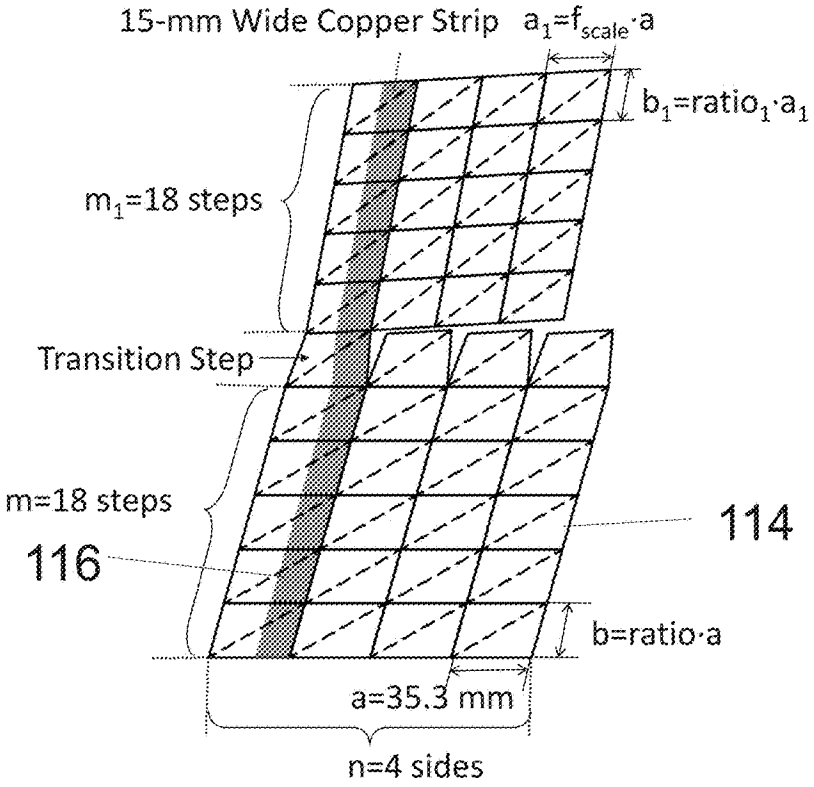
FIG. 5 shows a method of origami folding pattern of the dielectric sheet 114 and the conductive sheet 116 to make two helical sections 104 of the origami-folded antenna 100 shown in FIG. 4. Parameters $m_1$ and m are the number of steps of small and large helical sections 104, and n is the number of sides in the transverse section of the origami-folded antenna 100. The horizontal and vertical length of each pattern unit of small and large helical sections 104 are $a_1$, $b_1$, a, and b, respectively. The ratios of vertical and horizontal lengths in the small and large helical sections 104 are defined as $ratio_1$ or ratio, respectively. The scaling factor for the larger helical section 104 to the smaller helical section 104 is expressed as $f_{scale}$. For the results presented herein, the parameters are: ratio=0.7; $ratio_1$=0.79; and $f_{scale}$=0.8.

The dielectric sheets 114 can be folded using well-known origami folding techniques to make the helical sections 104. FIG. 5 shows the folding pattern for two helical sections 104 with different radii using the parameters: ratio=0.7, $ratio_1$=0.79 and $f_{scale}$=0.8. Prior to folding, the dielectric sheets 114 can include, but are not limited to, a square, parallelogram, rectangular shape. The dielectric sheets 114 can be folded along the dash lines (valley) and the solid lines (hill) to form the helical sections 104. The folding pattern can include repeated folded units. The repeated folded units can be made by folding along unit cells of the dielectric sheets 114. The unit cells can have many shapes. For example, the shape of the unit cell can include, but is not limited to, a square, parallelogram, rectangular shape. In FIG. 5, the unit cell is a parallelogram with a side a of about 35 mm and a side b of about 25 mm. By folding the pattern in FIG. 5 along hills and valleys, connecting the dielectric sheets 114 of the helical sections 104 and connecting the left and right sides, the two helices are formed and connected in series. The dielectric sheets 114 can be folded into a cylindrical shape, a cone shape and/or conical shape. For example, the dielectric sheets 114 can be conical shape having a cap radius and a base radius in which the cap radius is less than the base radius.

The helical section 104 can have various dimensions and configurations. The helical section 104 can include one or more helical turns. For example, the helical section 104 can have one, two, three, four, five, six, seven, eight, nine, ten or more helical turns 104. In FIG. 4, the helical sections 104 have three turns each. The helical turns 118 can have varying pitch angles. For example, the helical turns 118 can have a pitch angle (tan a) from a low of about 0 to a high of about 1.

The height and/or length along a central axis of the helical section 104 can vary widely. For example, the helical section 104 can have a height and/or length along a central axis from a short of about a short of about 1 mm, 15 mm, or 45 mm to a long of about 300 mm, about 500 mm, or about 15 cm. In another example, the helical section 104 can have a height and/or length along a central axis from about 1 mm to about 20 cm, about 20 mm to about 500 mm, about 38 mm to about 50 cm, about 38 mm to about 77.5 mm, or about 1 cm to about 15 cm.

The helical section 104 can have a radius that varies widely. For example, the helical section 104 can have radius from short of about 10 mm, about 25 mm, or about 75 mm to a long of about 200 mm, about 300 mm, or about 400 mm. In another example, the helical section 104 can have radius from about 40 mm to about 80 mm, about 50 mm to about 400 mm, about 55 mm to about 120 mm, about 65 mm to about 200 mm, about 100 mm to about 300 mm, about 125 mm to about 320 mm, or about 200 mm to about 390 mm. The helical section 104 can have a constant radius, which gives a three dimensional cylinder shape, or helical sections 104 can have decreasing or increasing radii, which gives a three dimensional a cone shape and/or conical shape.

There can be a transition section 120 between the helical sections 104. The height and/or length along a central axis of the transition section 120 between the helical sections 104 can vary widely. For example, the height and/or length along a central axis of the transition section 120 can be from a short of about 1 mm, about 2.5 mm, or about 5 mm to a long of about 10 mm, about 20 mm, or about 30 mm. In another example, the height and/or length along a central axis of the transition section 120 can be from about 4 mm to about 8 mm, about 5 mm to about 40 mm, about 15 mm to about 20 mm, or about 25 mm to about 30 mm.

Similar to the origami-folded antenna 100, the helical section 104 can be configured to many states of height and/or length along a central axis. The helical section 104 can have a greater height and/or length along the central axis when in the expanded state of height than when in the compressed state of height. The height and/or length along a central axis of the helical section 104 can depend on the number of folding steps, the size of $a_1$ and $b_1$, and the thickness of the dielectric sheet 114 and/or the conductive sheet 116. FIGS. 6-11, show an origami-folded antenna 100 in three states of height, i.e., expanded, semi-expanded, and compressed, where one of the helical section 104 is expanded, semi-expanded and compressed. In the compressed state of height and/or length along a central axis for the origami-folded antenna 100, the conductive sheet 116 of the folding segments are not touching and are not in electrical conductivity with respect to the each adjacent folding segments so the origami-folded antenna 100 does not short out even when it is fully compressed.

The helical sections 104 can be the same size or different sizes. For example, the helical sections 104 can have a volume ratio between any of the helical sections 104 of 1:1, 1:1.5, 1:2, 1:2.5, 1:3, 1:3.5, 1:4, 1:4.5, 1:5, 1:5.5, 1:6, 1:6.5, 1:7, 1;7.5, 1:8, or about 1:8.5. In another example, at the attachment of two helical sections 104, the width of the conductive sheets 116 can change from about 15 mm to about 7.5 mm and the radius of helical section 104 can change from about 25 mm to about 12.5 mm, giving a volume ratio between the two helical sections of 1:4.

In FIG. 5, the geometrical scale between the dielectric sheets 114 for the smaller helical section 104 and the dielectric sheets 114 for the larger helical section 104 is 0.8. The geometrical scale between the dielectric sheets 114 for the helical sections 104 can vary widely. For example, the geometrical scale between the dielectric sheets 114 for the helical section 104 can be from a low of about 0.2, about 0.3, or about 0.4 to a high of about 0.6, about 0.7, or about 0.8.

The feed line 106 can include, but is not limited to, coaxial cables, twin-leads, ladder lines, and waveguides. The coaxial cables can include, but is not limited to, a SubMiniature version A (SMA), 3.5 mm connecter, and 2.92 mm connecter. The feed line 106 can be attached or disposed to the ground plane 102 and helical sections 104 and/or the helical sections 104. The feed line 106 can be coupled to the transmitter and/or receiver.

The feed line 106 can have an electrical resistance that varies widely. For example, the feed line 106 can have an electrical resistance from a low of about 10Ω, about 20Ω, or about 40Ω to a high of about 100Ω, about 120Ω, and 150Ω. In another example, the feed line can be from about 10Ω to about 150Ω, about 20Ω to about 50Ω, about 30Ω to about 70Ω, or about 80Ω to about 140Ω.

A greater understanding of the present invention and of its many advantages may be had from the following examples, given by way of illustration. The following examples are illustrative of some of the methods, applications, embodiments and variants of the present invention. They are, of course, not to be considered as limiting the invention. Numerous changes and modifications can be made with respect to the invention.

EXAMPLES

Figure 12A:
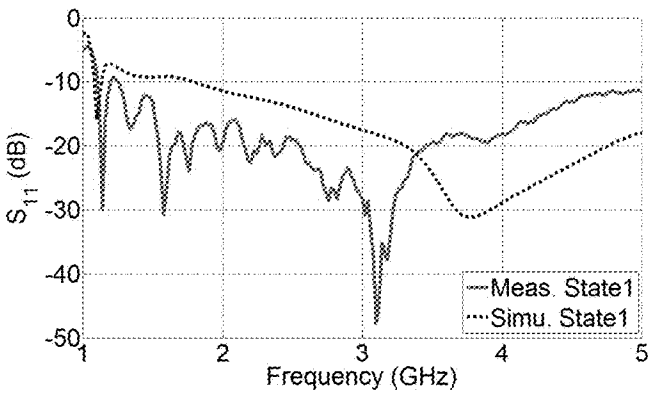
FIGS. 12A-C are plots of the reflection coefficient $S_{11}$ with respect to frequency for three states of height and/or length along a central axis of an origami-folded antenna 100.
Figure 12B:
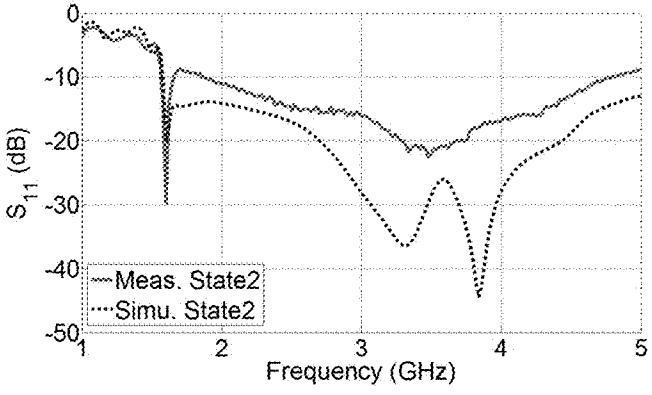
Figure 12C:
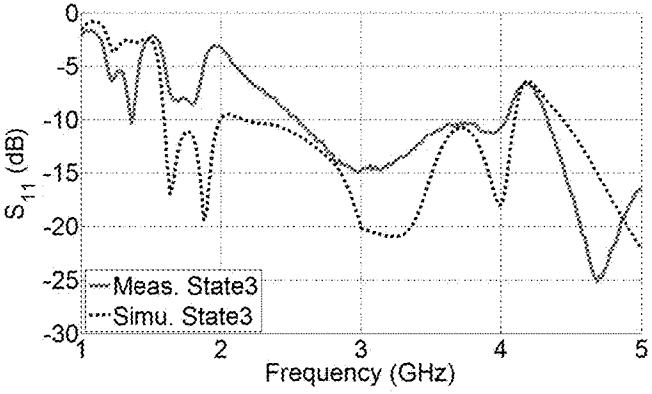
Figure 13A:
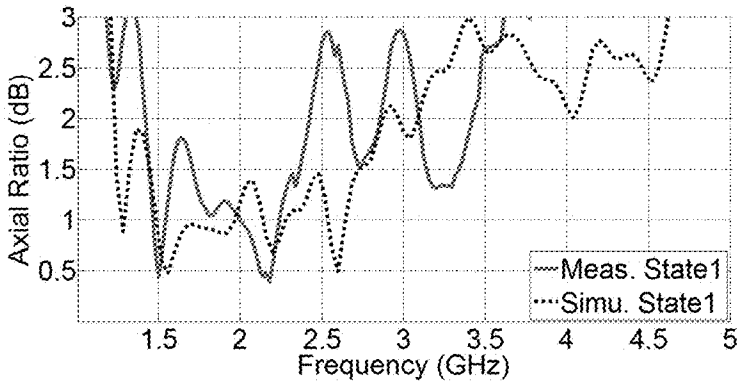
FIGS. 13A-C are plots of the axial ratio (AR) with respect to frequency for the three states of height and/or length along a central axis of an origami-folded antenna 100.
Figure 13B:
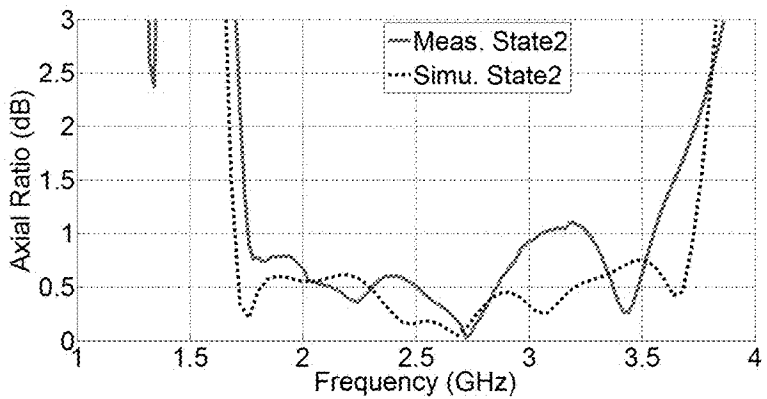
Figure 13C:
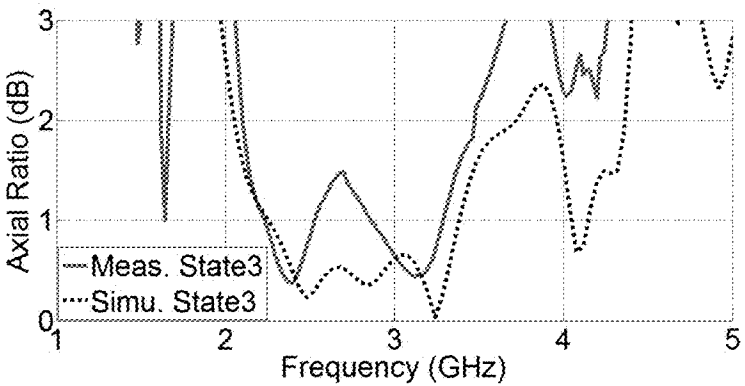
Figure 15:
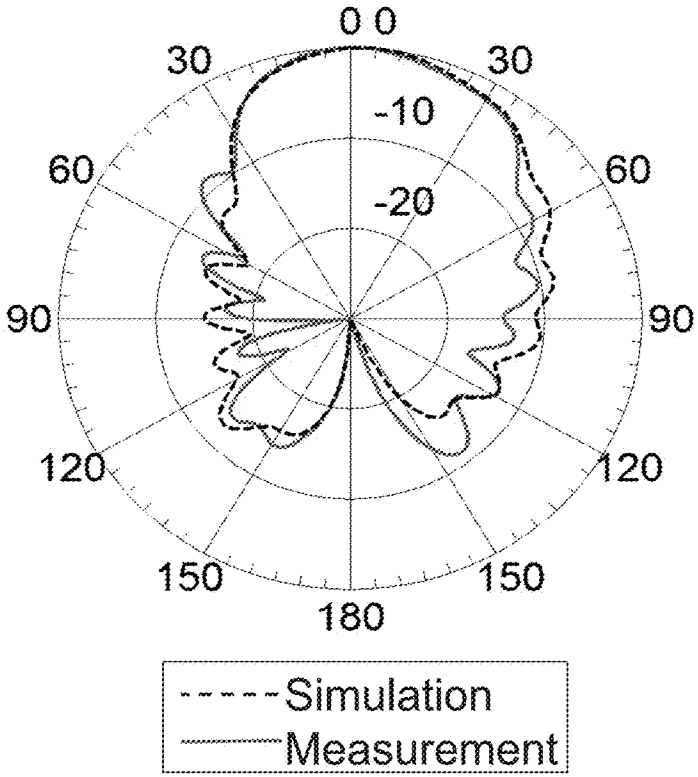
FIGS. 15-17 show the elevation-plane radiation patterns for the three states of height and/or length along a central axis of an origami-folded antenna 100 at typical operating frequencies noted with triangles in FIGS. 14A-C with respective to their frequency bands.
Figure 16:
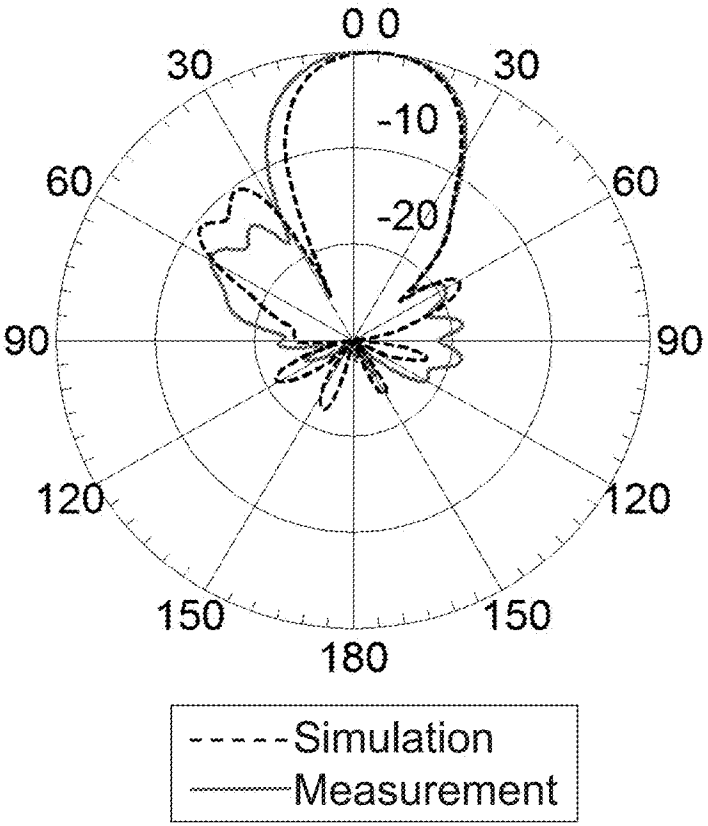
Figure 17:
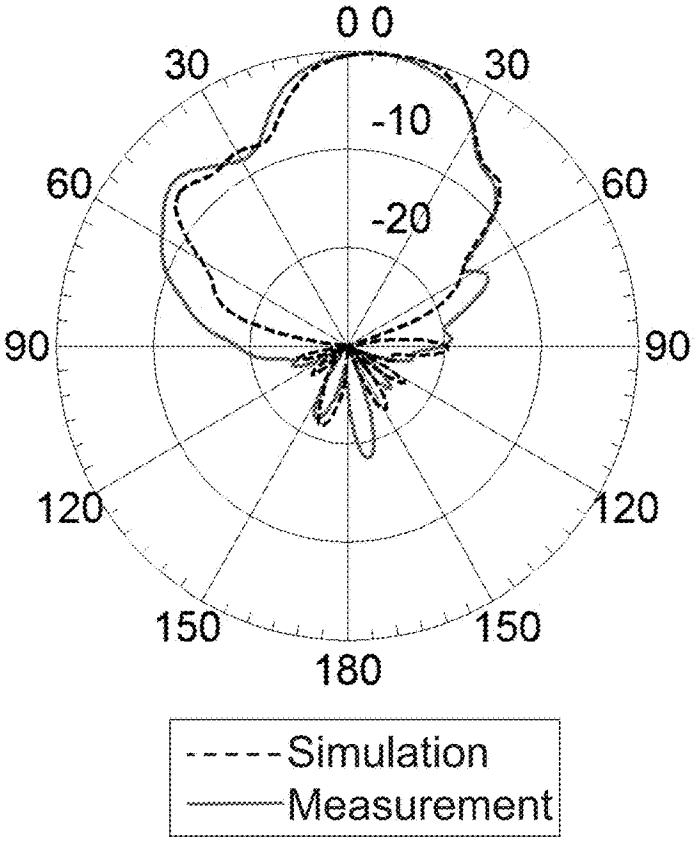

Simulated and measured results for an origami-folded antenna 100 at three states of height states and/or length along a central axis are shown in FIGS. 12-14. In FIGS. 14 A-C, the red blocks cover the measured CP frequency band (AR<3 dB) from about 1.38 GHz to about 3.6 GHz of the unfolded state (state 1), the measured CP frequency band from about 1.72 GHz to about 3.86 GHz of the semi-folded state (state 2), and the measured CP frequency bands 2.06 GHz-3.64 GHz & 3.92 GHz-4.26 GHz of the folded state (state 3). In each frequency band, the realized-gain variation is within about +3 dB. FIG. 15-17 shows the radiation patterns at each state in their CP frequency band. FIGS. 13A-B shows that all the three states are circularly polarized (AR<3 dB) within their frequency bands.

Compared to only a 6-turn origami large uniform helix, the CP bandwidth is enhanced at all the three states due to the serial smaller helix of this antenna, as shown in FIG. 27. The height of the origami-folded antenna is different than the one with a large uniform helix because $\theta_1$ is tuned to achieve wide CP bandwidths in the three states.

Compared to a 16-step origami conical bifilar spiral antenna [5], the origami-folded antenna 100 gives a wider CP bandwidth at all the states of height, and with a simpler feeding structure. Also, the CP bandwidth can be larger than a standard monofilar antenna or a standard multi-radii monofilar, as shown in FIG. 28, where the two radii of the multi-radii monofilar helix are 22.5 mm and 18 mm ($f_{scale}$=0.8), and the radius of the standard monofilar helix is 22.5 mm. The pitches and pitch angles of the standard monofilar and of the large helices in the two multi-radii antennas are all 31.3 mm and 12.5°, which fall into the optimum range (12° to 14°) [3]. All three antennas have the same uniform copper width of 15 mm and total number of turns. All other conditions are the same, including ground plane size (L=200 mm), distance from the ground (3.5 mm), positions of SMA feeding port and antenna.

Figure 18:
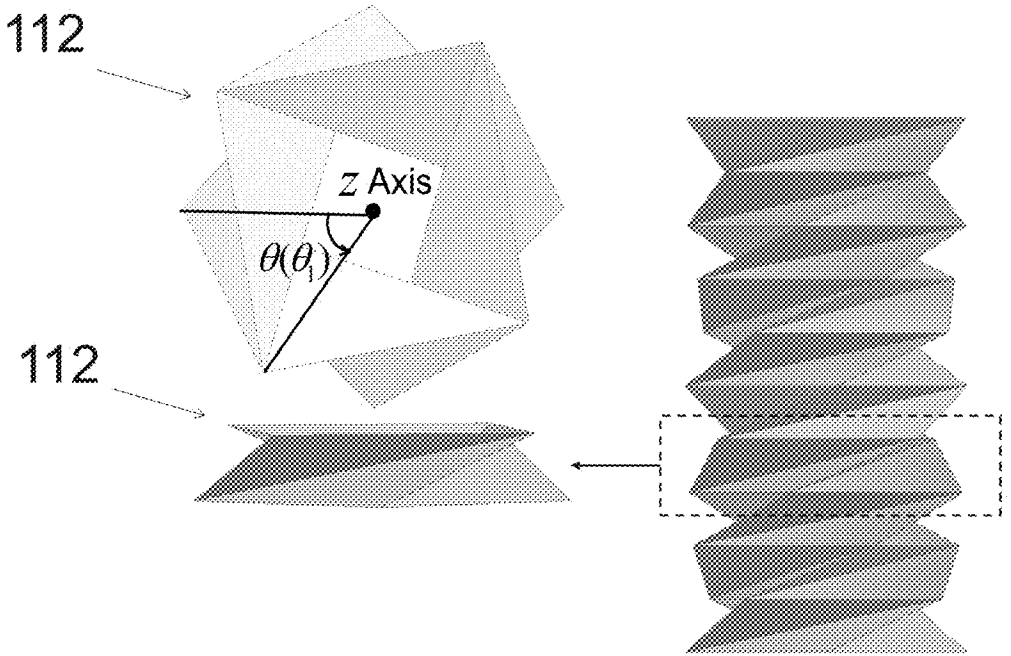
FIG. 18 illustrates definitions of the folding angle $\theta$ or $\theta_1$ for the folded segments 112 of the helical section 104.

With constant side length (i.e., a and b) and numbers of sides and steps (i.e., n and m) illustrated in FIG. 5, the ratios between b and a (i.e., ratio), and $b_1$ and $a_1$ (i.e., $ratio_1$) determine the pitch sizes of the large and small helices (i.e., pitch and $pitch_1$) respectively without affecting the number of turns of the large and small helices (i.e., N and $N_1$) in the origami folded antenna, as shown below:

$$\text{pitch} = n \cdot a \sqrt{\frac{\text{ratio}^2 \cdot \sin^2\left(\frac{180°}{n}\right)}{\sin^2\left(\frac{\theta}{2}\right)} - 1},$$

$$\text{pitch}_1 = n \cdot a_1 \sqrt{\frac{\text{ratio}_1^2 \cdot \sin^2\left(\frac{180°}{n}\right)}{\sin^2\left(\frac{\theta_1}{2}\right)} - 1},$$

where $\theta$ and $\theta_1$ are the folding angles around the helical axis between adjacent steps, as shown in FIG. 18.

Figure 19:
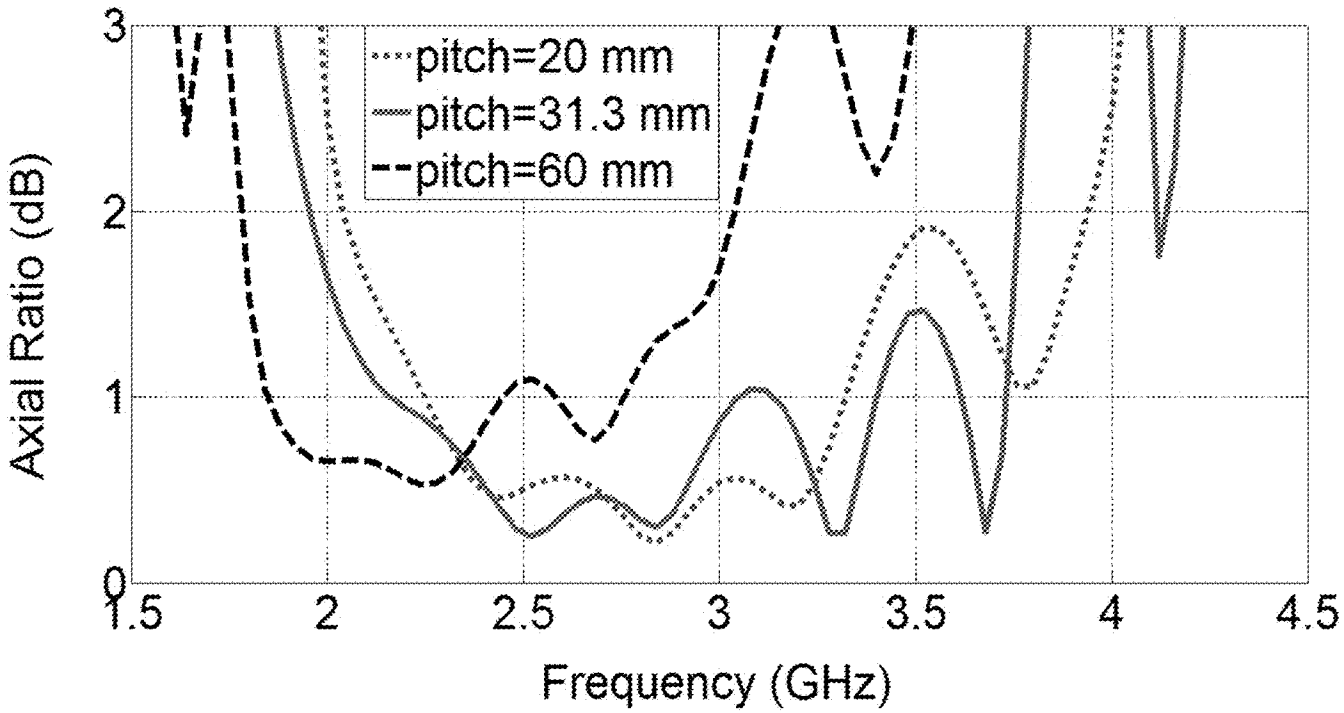
FIG. 19 shows the simulated analysis of the axial ratio for the parameter pitch.

FIG. 19 shows that when pitch increases then the frequency band, where the antenna exhibits circular polarization, shifts to lower frequencies.

Figure 20:
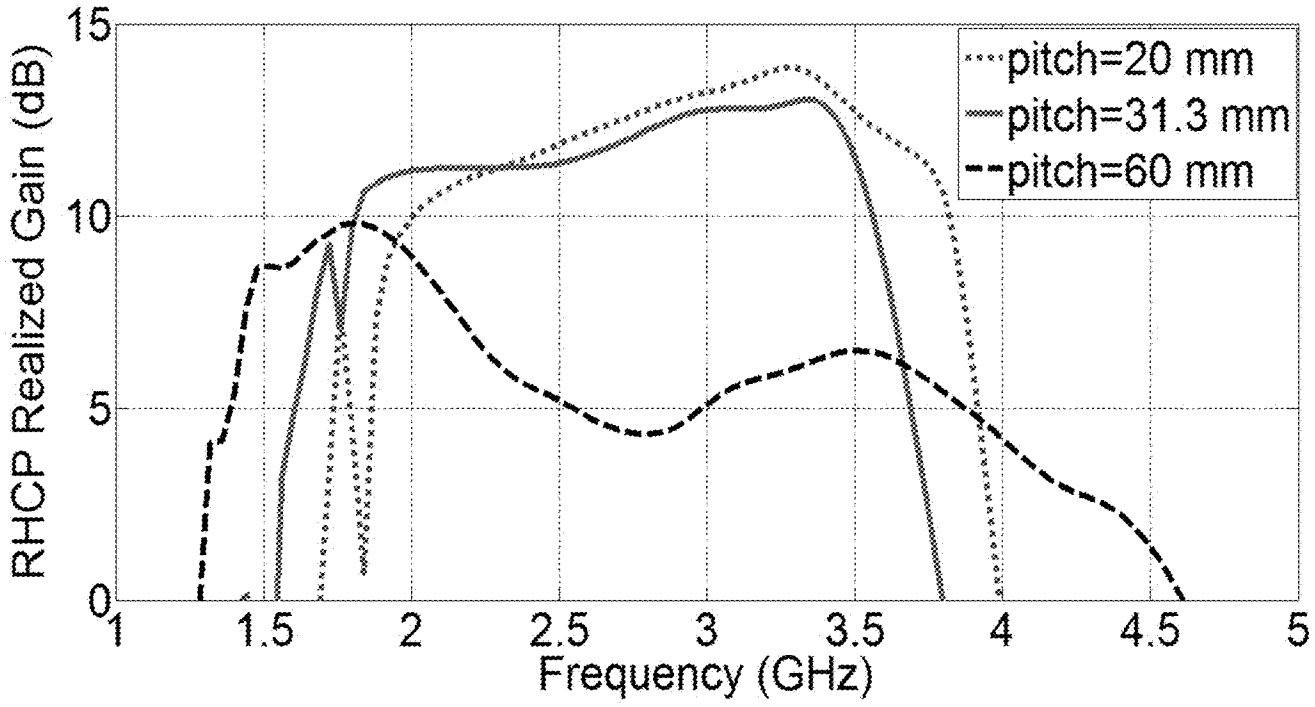
FIG. 20 shows the simulated analysis of the RHCP realized gain for the parameter pitch.

FIGS. 20 and 29 show that there is an optimal pitch (i.e., pitch=31.3 mm) that provides the widest bandwidth with +1 dB RHCP gain variation from the maximum RHCP gain.

Figure 21:
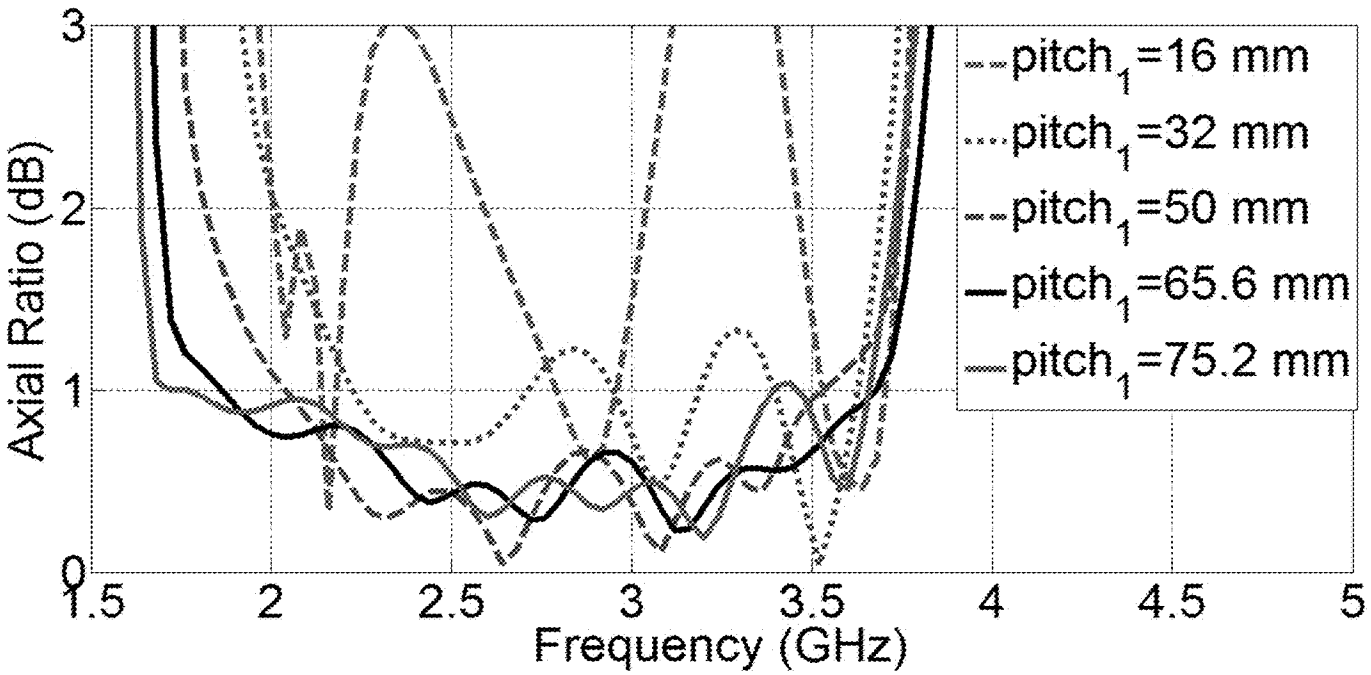
FIG. 21 shows the simulated analysis of the axial ratio for the parameter $pitch_1$.

FIG. 21 shows that the lowest operational frequency of the CP bandwidth decreases as $pitch_1$ increases.

Figure 22:
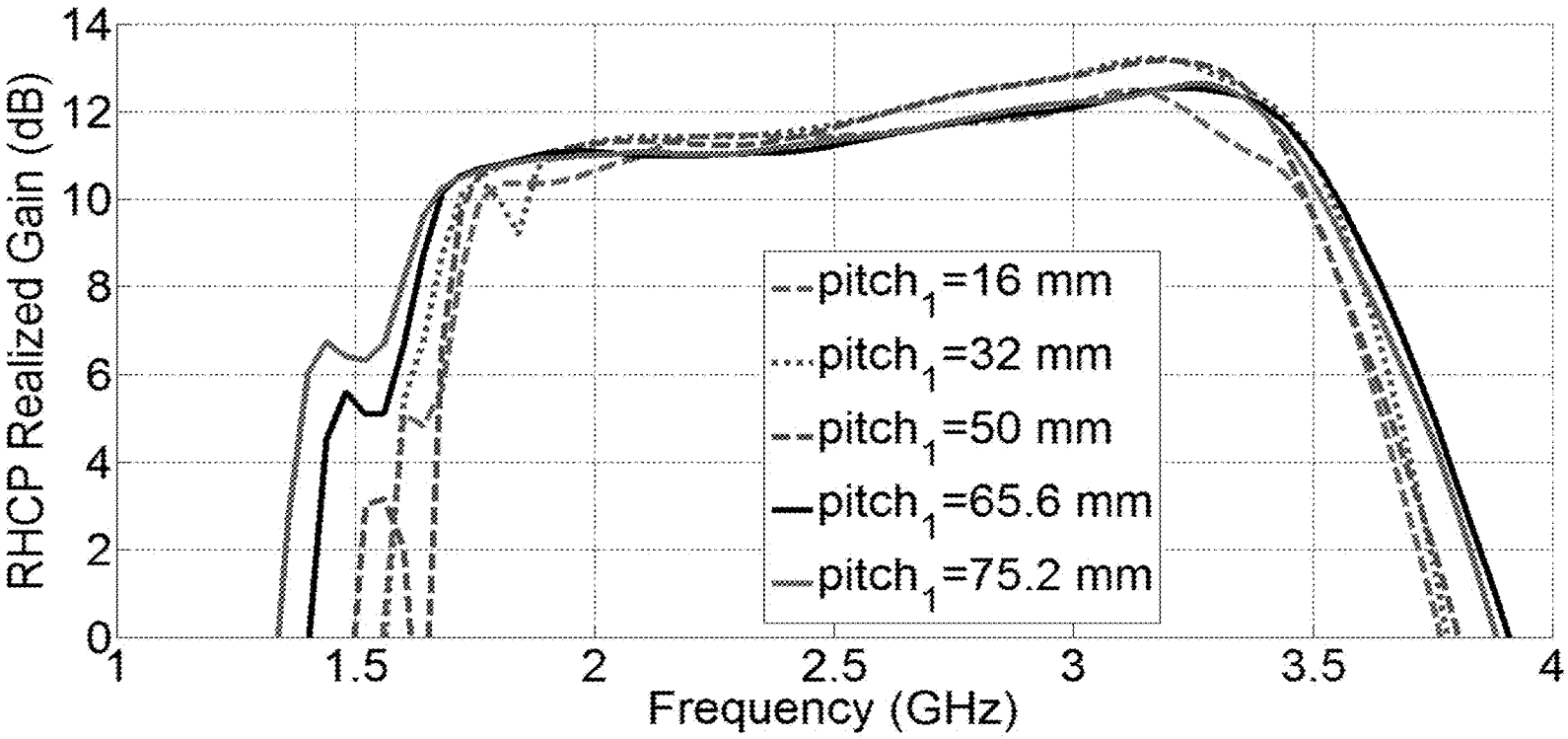
FIG. 22 shows the simulated analysis of the RHCP realized gain for the parameter $pitch_1$.

FIGS. 22 and 30 show that as $pitch_1$ increases the maximum AR in the gain bandwidth decreases, and there is an optimal $pitch_1$ (i.e., $pitch_1$=65.6 mm) that provides the widest bandwidth with ±1 dB RHCP gain variation from the maximum.

Figure 23:
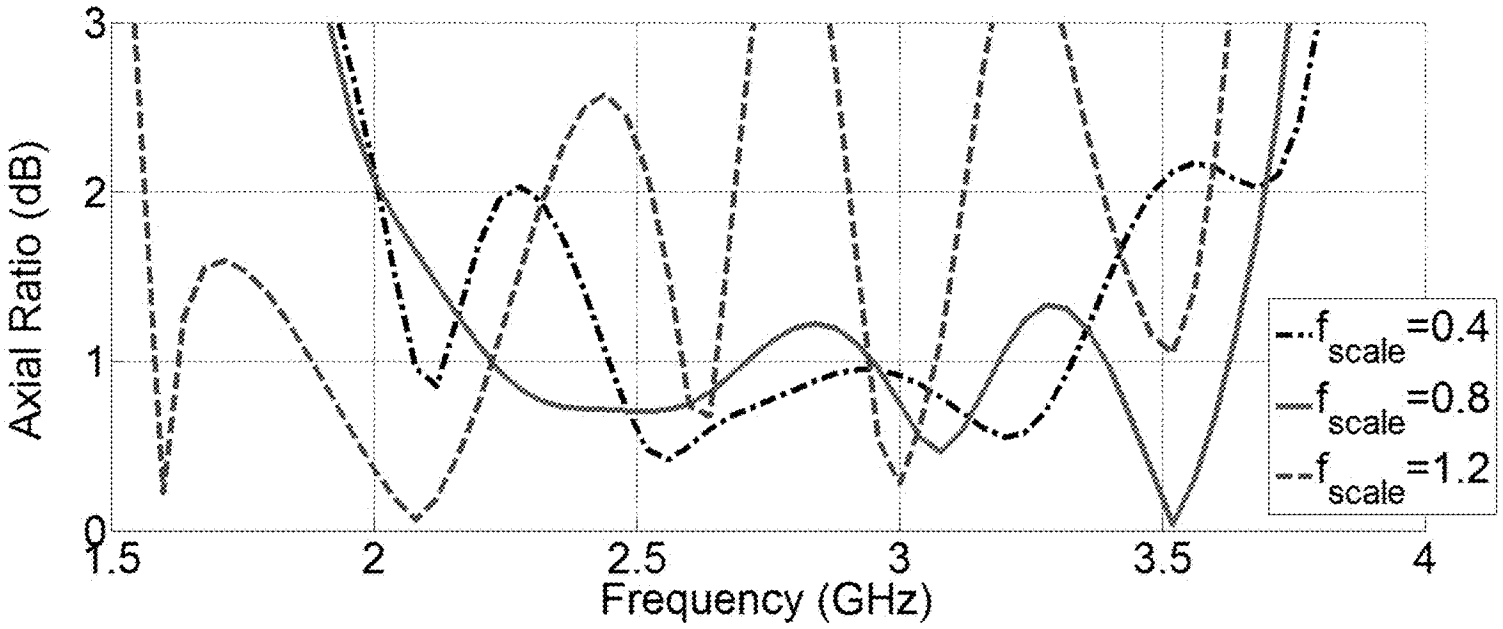
FIG. 23 shows the simulated analysis of the axial ratio for the parameter $f_{scale}$.
Figure 24:
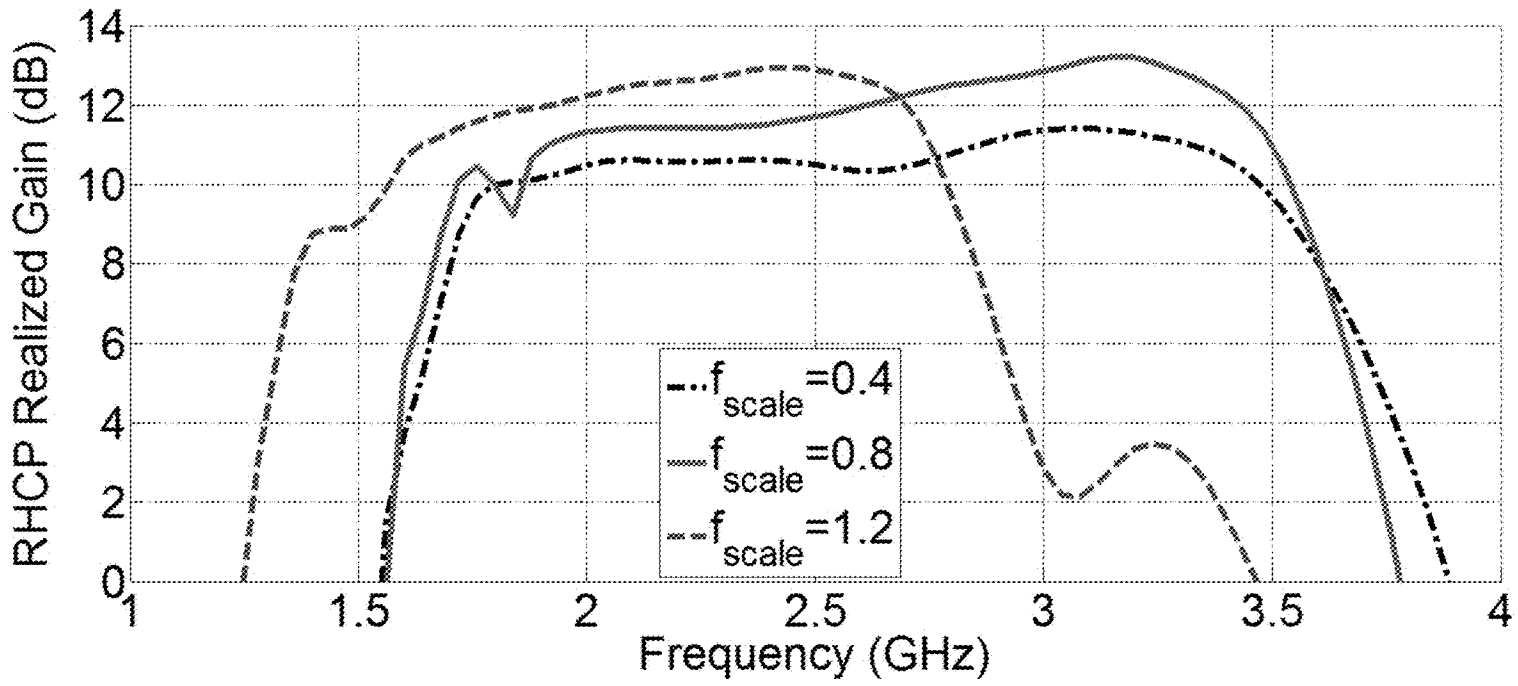
FIG. 24 shows the simulated analysis of the RHCP realized gain for the parameter $f_{scale}$.
Figure 25:
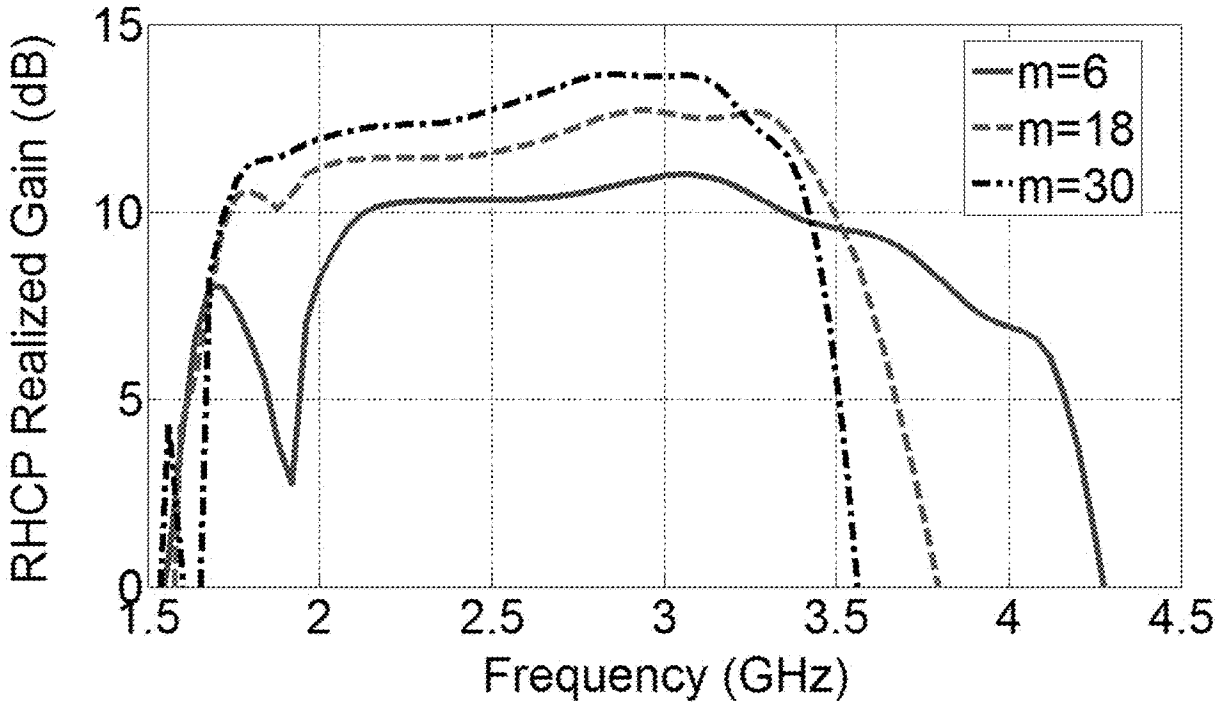
FIG. 25 shows the simulated analysis of the axial ratio for the parameter m.
Figure 26:
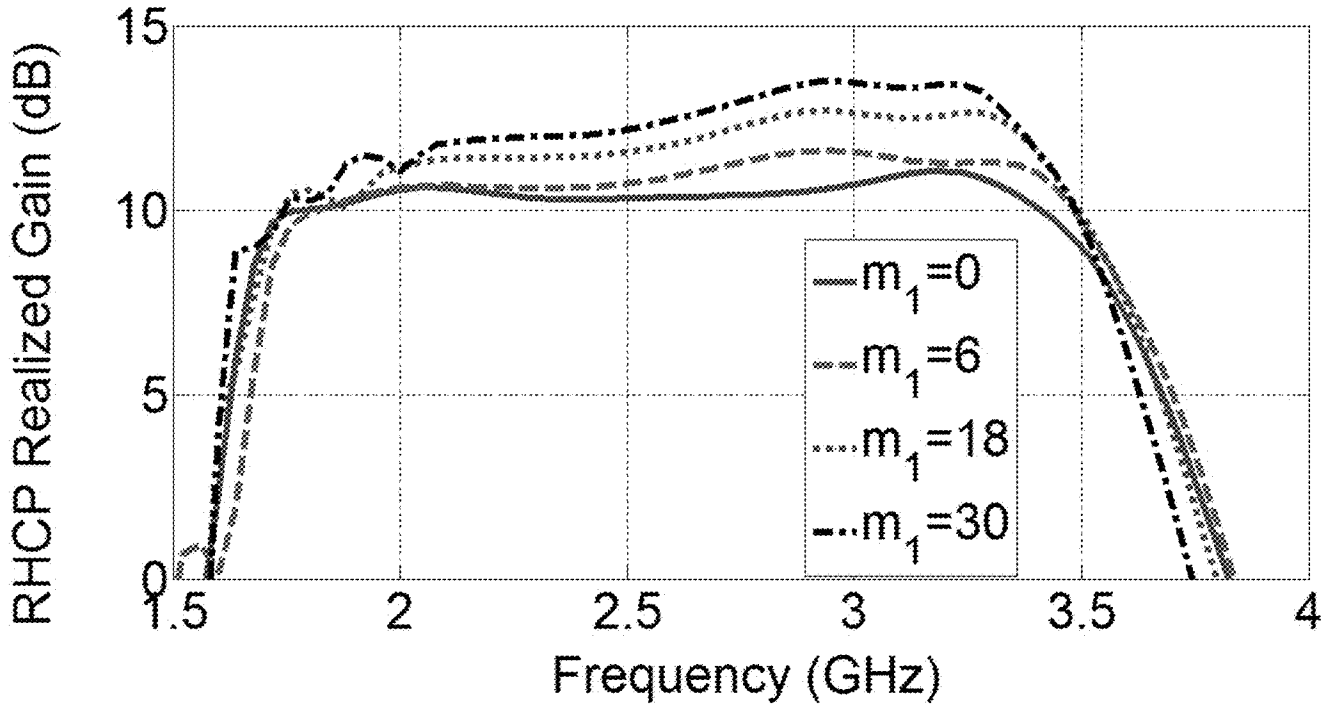
FIG. 26 shows the simulated analysis of the RHCP realized gain for the parameter m.

The variable $a_1$ is defined according to the equation:

$$a_1 = f_{scale} \cdot a;$$

hence, the $f_{scale}$ is also the ratio of the radii of the small and large helices. The variable $a_1$ is examined by varying $f_{scale}$ with a=35.3 mm and other parameters fixed, as shown in FIGS. 23, 24 and 31. FIG. 23 shows that that when $f_{scale}$ increases the CP frequency bandwidth decreases. FIG. 24 shows that the maximum gain is achieved when $f_{scale}$=0.8, also when $f_{scale}$ becomes larger than 1, the operating bandwidth of the antenna shifts to lower frequencies. FIG. 31 demonstrates that $f_{scale}$ (i.e., $a_1$) should be selected properly to optimize the trade-off between maximum RHCP gain and gain bandwidth with +1 dB RHCP gain variation from the maximum.

FIGS. 25, 26, 32, and 33 show that when m or $m_1$ increases, the maximum RHCP gain increases, while the gain bandwidth (calculated from the frequencies that exhibit gain within +1 dB from the maximum gain) first increases and, then, starts decreasing. Therefore, m and $m_1$ can be chosen so that the trade-off between maximum gain and gain bandwidth is optimized. The results were obtained with $m_1$=18 for m, and m=18 for $m_1$.

Also, the effect of changing $\theta$ and $\theta_1$ with fixed ratios [4] is similar with changing pitch and $pitch_1$ while the number of turns (N and $N_1$) slightly increase with folding angles increasing, which can ultimately provide a frequency reconfigurability with circular polarization at all the states of height.

Compared to the traditional helix and traditional multi-radii helix, the origami multi-radii helix has the best impedance matching and widest gain bandwidth. Also, the origami multi-radii helix has the ability to reconfigure its operating frequency band in multiple states by adjusting its height. As shown in FIG. 27, this origami multi-radii helix has wider gain bandwidth than the traditional origami helix, in all the three states. Also, the origami multi-radii helix is circularly polarized at three reconfigurable states (compressed, semi-expanded. and expanded state) whereas the origami helix is circularly polarized only at two states (semi-expanded and expanded), as show in FIG. 28.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility. It is therefore intended by the appended claims to cover any and all such applications, modifications and embodiments within the scope of the present invention.

It should be understood that the examples and embodiments described herein are for illustrative purposes only and that various modifications or changes in light thereof will be suggested to persons skilled in the art and are to be included within the spirit and purview of this application.

All patents, patent applications, provisional applications, and publications referred to or cited herein (including those in the "References" section) are incorporated by reference in their entirety, including all figures and tables, to the extent they are not inconsistent with the explicit teachings of this specification.

REFERENCES

[1] U.S. Pat. No. 9,214,722

[2] J. L. Wong and H. E. King, "Broadband quasi-taper helical antennas," in IEEE Trans. on Ant. and Propag., vol. AP-27, no. 1, pp. 72-78, January 1979.

[3] X. Liu, S. Yao, B. S. Cook, M. M. Tentzeris, and S. V. Georgakopoulos, "An origami reconfigurable axial-mode bifilar helical antenna," in IEEE Trans. on Ant. and Propag., vol. 63, no. 12, pp. 5897-5903, December 2015.

[4] X. Liu, S. Yao, S. V. Georgakopoulos, and M. M. Tentzeris, "Reconfigurable origami equiangular conical spiral antenna," in Proc. Antennas Propag. Soc. Int. Symp. (APSURSI), Vancouver, B C, 2015, pp. 2263-2264.

[5] C. D. Onal, M. T. Tolley, R. J. Wood, and D. Rus, "Origami-inspired printed robots," IEEE/ASME Trans. on Mech., vol. 20, no. 5, pp. 2214-2221, October 2015.

[6] S. M. A. M. H. Abadi, J. H. Booske, and N. Behdad, "Exploiting mechanical flexure as a means of tuning the responses of large-scale periodic structures," submitted to IEEE IEEE Trans. on Ant. and Propag., in press.

What is claimed is:

1. An origami-folded antenna, the origami-folded antenna comprising:

one or more ground planes, the ground planes comprising:

a dielectric stratum, and a conductive stratum, the dielectric stratum being at least partially disposed on the conductive stratum;

two or more helical sections, the helical sections comprising:

a dielectric sheet, and a conductive sheet having a first end and a second end, the conductive sheet being at least partially disposed on the dielectric sheet, the dielectric sheet being folded into one or more folded segments to make two or more helical turns connected in a series having an elongated center axis, the conductive sheet defining an electrical current path from the first end of the conductive sheet to the second end of the conductive sheet, the folded segments comprising creases that are transverse to the center axis of the helical section; and one or more feed lines, the origami-folded antenna configured to be expanded to an expanded state and compressed to a compressed state along a center axis, and the antenna having a greater length along the center axis when in the expanded state than when in the compressed state, a first helical section of the two or more helical sections having a radius of about 50 mm and a second helical section of the two or more helical sections having a radius of about 40 mm, the origami-folded antenna having measured circular polarized bandwidths from about 1.38 GHz to about 3.6 GHz with a fractional bandwidth Δf=89.2% for a state of height of 552 mm, about 1.72 GHz to about 3.86 GHz with fractional bandwidth Δf=76.7% for a state of height of 318 mm, and about 3.92 GHz to about 4.26 GHz with a fractional bandwidth Δf=8.3% for a state of height of 251 mm, and an axial ratio being less than 3 dB and a measured right-hand circularly polarized (RHCP) gain being from 3 dB to 12 dB.

2. The origami-folded antenna according to claim 1, the origami-folded antenna has a length along the center axis expandable from about 3.8 cm to about 77.5 cm.

3. The origami-folded antenna according to claim 1, the origami-folded antenna has a measured operating bandwidth from about 1.38 GHz to about 4.26 GHz.

4. The origami-folded antenna according to claim 1, the dielectric sheet comprises a material consisting of: ceramics, papers, cardboards, plastics, polymers, resins, glass, and combinations thereof.

5. The origami-folded antenna according to claim 1, the conductive sheet comprises a material consisting of: metals, including copper, silver, gold, aluminum, brass, zinc nickel, iron, tin, steel, lead, nickel, metal oxides, and alloys; polymers; and combinations thereof.

6. A method of making an origami-folded antenna, the method comprising:

disposing a dielectric stratum onto a conductive stratum to make a ground plane;

disposing a conductive sheet onto a dielectric sheet, the conductive sheet defining an electrical current path from a first end of the conductive sheet to a second end of the conductive sheet;

folding the dielectric sheet into one or more folded segments to make two or more helical sections connected in a series, each helical section comprising a cylinder shape, the folded segments having creases that are transverse to a center axis of the cylindrical shape, each helical section being configured to be expanded or compressed along the center axis of the cylindrical shape, and each helical section having a greater length along the center axis when expanded than when compressed; and attaching a first helical section to the ground plane, the origami-folded antenna having a greater length along a center axis when in the expanded state than when in the compressed state, the origami-folded antenna being tuned by adjusting a state of height of the origami-folded antenna between the compressed state and the expanded state, the origami-folded antenna having measured circular polarized bandwidths from about 1.38 GHz to about 3.6 GHz with a fractional bandwidth Δf=89.2% for a state of height of 552 mm, about 1.72 GHz to about 3.86 GHz with fractional bandwidth Δf=76.7% for a state of height of 318 mm, and about 3.92 GHz to about 4.26 GHz with a fractional bandwidth Δf==8.3% for a state of height of 251 mm, and an axial ratio being less than 3 dB and a measured right-hand circularly polarized (RHCP) gain being from 3 dB to 12 dB.

7. The method according to claim 6, the conductive sheet comprises a material consisting of: metals, including copper, silver, gold, aluminum, brass, zinc nickel, iron, tin, steel, lead, nickel, metal oxides, 3-D printable conductive filament, and alloys; polymers; and combinations thereof.

8. The method according to claim 6, wherein the origami-folded antenna has a measured operating bandwidth from about 1.38 GHz to about 4.26 GHz.

9. The method according to claim 6, wherein there are two helical sections, wherein a first helical section has a radius of about 50 mm and a second helical section has a radius of about 40 mm.

10. The method according to claim 6, wherein the origami-folded antenna has a length along the center axis expandable from about 3.8 cm to about 77.5 cm.

* * * * *